US010755527B2

(12) United States Patent
Rottcher

(10) Patent No.: US 10,755,527 B2
(45) Date of Patent: Aug. 25, 2020

(54) GAMING MACHINE WITH HOT MODE

(71) Applicant: Digital Gaming Corporation Limited, London (GB)

(72) Inventor: Hylton Rottcher, Durban (ZA)

(73) Assignee: FUSION HOLDINGS LIMITED, Douglas (IM)

( * ) Notice: Subject to any disclaimer, the term of this patent is extended or adjusted under 35 U.S.C. 154(b) by 165 days.

(21) Appl. No.: 15/912,469

(22) Filed: Mar. 5, 2018

(65) Prior Publication Data

US 2018/0268660 A1 Sep. 20, 2018

(30) Foreign Application Priority Data

Mar. 17, 2017 (GB) ..... 1704322.5

(51) Int. Cl.
*G07F 17/32* (2006.01)

(52) U.S. Cl.
CPC ..... *G07F 17/3267* (2013.01); *G07F 17/3213* (2013.01); *G07F 17/3244* (2013.01)

(58) Field of Classification Search
CPC ..... G07F 17/3267; G07F 17/3213; G07F 17/3244; G07F 17/3223; G07F 17/3227; G07F 17/323; G07F 17/3234; G07F 17/3237; G07F 17/3255; G07F 17/3258; G07F 17/3262
See application file for complete search history.

(56) References Cited

U.S. PATENT DOCUMENTS 6,932,702 B1 * 8/2005 Harris ..... G07F 17/32 463/16
8,814,661 B2 * 8/2014 Thorne ..... G07F 17/3227 463/16
9,111,421 B2 * 8/2015 Soong ..... G07F 17/3267
9,646,463 B2 * 5/2017 Hsu ..... G07F 17/3267
9,934,651 B2 * 4/2018 Watkins ..... G07F 17/3258
(Continued)

OTHER PUBLICATIONS

Aruze Gaming, "Hot Mode Festival—Aruze Gaming Inc.", 2014, availalble via the Internet at aruzegaming.com/innovator/hot-mode-festival/ (last visited May 21, 2018).
(Continued)

*Primary Examiner* — Omkar A Deodhar
*Assistant Examiner* — Matthew D Hoel
(74) *Attorney, Agent, or Firm* — McDonnell Boehnen Hulbert & Berghoff LLP

(57) ABSTRACT

A gaming machine with a hot mode is disclosed. A processor of the gaming machine can determine whether the gaming machine is in a hot mode state. After determining that the gaming machine is in the hot mode state, the gaming machine can determine a number of hot mode spins and perform each hot mode spin of the number of hot mode spins. Performing a hot mode spin can include receiving a wager, determining an outcome of a random event, generating a display related to the outcome of the random event, and determining a payout for the wager based on the outcome of the random event and a hot-mode return rate. The hot-mode return rate can be selected so that a sum of payouts during the number of hot mode spins is expected to exceed a sum of wagers made during the number of hot mode spins.

20 Claims, 17 Drawing Sheets

(56) References Cited

U.S. PATENT DOCUMENTS

| | | | | |
|---|---|---|---|---|
| 2005/0125244 | A1* | 6/2005 | Schneider | G07F 17/3288 705/1.1 |
| 2009/0156286 | A1* | 6/2009 | Ditton | G07F 17/3286 463/18 |
| 2010/0075733 | A1* | 3/2010 | Breslo | G07F 17/32 463/17 |
| 2012/0034966 | A1* | 2/2012 | Soong | G07F 17/3267 463/20 |
| 2013/0137519 | A1* | 5/2013 | Hsu | G07F 17/3267 463/42 |
| 2013/0157733 | A1* | 6/2013 | Thorne | G07F 17/323 463/1 |
| 2015/0170477 | A1* | 6/2015 | Souza | G07F 17/34 463/20 |
| 2018/0268660 | A1* | 9/2018 | Rottcher | G07F 17/3244 |

OTHER PUBLICATIONS

BWIN.Party Digital Entertainment PLC, "Help—Casino—Terminator 2", May 16, 2018, available via the Internet at help.partycasino.com/en/casino-help/slots/mgsterminator2 (last visited May 21, 2018).

Stopandstep.com,"Hot Slot—£500 Jackpot Slot Machine in Coral Bookies", Aug. 6, 2017, available via the Internet at web.archive.org/web/20170806001033/stopandstep.com/hot-slot-2/ (last visited May 21, 2018).

Vegasslotsonline.com,"Playboy Slots—Download Bally's Playboy Hot Zone Slot Machine",Feb. 13, 2015, available via the Internet at web.archive.org/web/20150401000000*/http://www.vegasslotsonline.com/bally/playboy-hot-zone/ (last visited May 21, 2018).

* cited by examiner

600

GAMING MACHINE WITH HOT MODE

CROSS-REFERENCE TO RELATED APPLICATIONS

This application claims priority under 35 U.S.C. § 119 to United Kingdom Patent Application No. 1704322.5 filed Mar. 17, 2017. United Kingdom Patent Application No. 1704322.5 is hereby incorporated by reference in its entirety for all purposes.

BACKGROUND

Wager games come in a variety of forms, including wager games played using a mechanical slot machine. A mechanical slot machine may include one or more reels, each of which includes a fixed pattern of symbols distributed around the circumference of the reel. When a player places a wager (e.g., by placing a coin in the machine), the player is allowed to spin the reels. Each reel then comes to rest, typically with either one of the symbols, or a space in between symbols, in alignment with a pay line. A predefined winning symbol or a predefined combination of winning symbols that are aligned with the pay line can result in the player winning the game and receiving a payout. In one example, the machine may include three reels, and the pay line may be a horizontal line disposed across a centre of each of the three reels.

In another example of a wager game, a mechanical slot machine may present symbols in a matrix arrangement, with each symbol changing during a spin of the game according to the fixed pattern of symbols on the reels. For example, the machine may have five columns and three rows of symbols, for a total of fifteen symbols. Such machines often have multiple pay lines, each being defined by a collection of positions within the matrix. For instance, the machine may have three pay lines, each corresponding to one row of the matrix.

SUMMARY

While slot machines were traditionally mechanical, modern slot machines often take the form of a video gaming machine (e.g., a dedicated gaming machine located in a casino) that includes a graphical user interface (GUI), and that may emulate a mechanical slot machine. With a video gaming machine, the GUI may display an image of one or more reels or a matrix as described above, together with animation effects to simulate a spin of the one or more reels, or a spin of the columns or rows of the matrix. A computer software program, which may reside in the video gaming machine, may randomly select one or more symbols in response to a spin, and may display the selected one or more symbols on the display.

A modern slot machine may also be played over a computer network, such as by a player using a client machine that is connected to a server machine by the computer network. In this instance, the server machine may perform the spins of the game and may send data representing the resulting symbols to the client machine, thereby instructing the client machine to display the symbols.

In particular, a "hot mode" of a wager game and related gaming machines is described herein. The hot mode can be considered as a particular state of a wager game and/or gaming machine. A player can enter into the hot mode state via a triggering mechanism of the gaming machine that acts similarly as a triggering mechanism used to enter into a bonus game state or free spin state. Another state of the wager game and/or gaming machine can be a "normal" state that is outside of the hot mode state.

The gaming machine can indicate that the gaming machine is (or is not) in the hot mode state. One invocation of the hot mode state can last for a number of spins of the gaming machine, which can be a randomly determined number of spins. The player must place a wager for each hot mode spin; that is, a hot mode spin is not a free spin. While in the hot mode state, an actual and/or an expected return to player (RTP) is over 100%. In some examples, if the player makes a wager of value V1 for each hot mode spin in the hot mode state, the return to the player will equal or exceed V1; while in other examples, if the player makes a sum of wagers V2 while in the hot mode state, the return to the player will equal or exceed V2, allowing for the possibility of some hot mode spins being losing spins. In still other examples, if player makes a sum of wagers V2 while in the hot mode state, the return to the player is predicted to exceed V2 but may not actually exceed V2 due to randomness in the game. Thus, the player of the gaming machine has an interest to keep wagering at least while the gaming machine is in the hot mode state.

In contrast, during at least the normal state, the RTP can be under 100%; that is, if player makes a sum of wagers V3 while in the normal state, the RTP of these wagers may be less than V3. In some examples, the RTP in the normal state can equal or exceed 100% as well, but such returns may not be expected and/or guaranteed in the normal state. By putting a gaming machine into a hot mode state with an expected and/or actual RTP of at least 100%, player enjoyment can be enhanced and subsequent player wagering can be increased.

In one aspect, a computer-implemented method is provided. A processor of a gaming machine determines whether the gaming machine is in a hot mode state. After determining that the gaming machine is in the hot mode state, the gaming machine: determines a number of hot mode spins; performs each hot mode spin of the number of hot mode spins by at least: receiving a wager at the gaming machine, determining an outcome of a random event using the processor, generating a display related to the outcome of the random event using the processor, and determining a payout for the wager based on the outcome of the random event and a hot-mode return rate, where the hot-mode return rate is selected so that a sum of payouts determined during the number of hot mode spins is expected to exceed a sum of wagers made during the number of hot mode spins.

In a second aspect, an article of manufacture is provided. The article of manufacture includes a computer-readable medium, having stored thereon instructions that, upon execution by a processor of a gaming machine, cause the gaming machine to perform operations. The operations include: determining whether the gaming machine is in a hot mode state; and after determining that the gaming machine is in the hot mode state: determining a number of hot mode spins; performing each hot mode spin of the number of hot mode spins by at least: receiving a wager, determining an outcome of a random event using the processor; generating a display related to the outcome of the random event using the processor, and determining a payout for the wager based on the outcome of the random event and a hot-mode return rate, where the hot-mode return rate is selected so that a sum of payouts determined during the number of hot mode spins is expected to exceed a sum of wagers made during the number of hot mode spins.

In a third aspect, a gaming machine is provided. The gaming machine includes a processor; memory; and program instructions, stored in the memory, that upon execution by the processor cause the gaming machine to perform operations. The operations include: determining whether the gaming machine is in a hot mode state; and after determining that the gaming machine is in the hot mode state: determining a number of hot mode spins; performing each hot mode spin of the number of hot mode spins by at least: receiving a wager, determining an outcome of a random event using the processor; generating a display related to the outcome of the random event using the processor, and determining a payout for the wager based on the outcome of the random event and a hot-mode return rate, where the hot-mode return rate is selected so that a sum of payouts determined during the number of hot mode spins is expected to exceed a sum of wagers made during the number of hot mode spins.

In a fourth aspect, a gaming machine is provided. The gaming machine includes: means for determining whether the gaming machine is in a hot mode state; and means for, after determining that the gaming machine is in the hot mode state: determining a number of hot mode spins; performing each hot mode spin of the number of hot mode spins by at least: receiving a wager, determining an outcome of a random event using the processor; generating a display related to the outcome of the random event using the processor, and determining a payout for the wager based on the outcome of the random event and a hot-mode return rate, where the hot-mode return rate is selected so that a sum of payouts determined during the number of hot mode spins is expected to exceed a sum of wagers made during the number of hot mode spins.

In a fifth aspect, a system is provided that includes a gaming machine of the third aspect and/or a gaming machine of the fourth aspect.

In embodiments of the disclosure in which a computer software product is used, the product may be non-transitory and store instructions on physical media such as a DVD, or a solid state drive, or a hard drive. Alternatively, the product may be transitory and in the form of instructions provided over a connection such as a network connection which is linked to a network such as the Internet.

These aspects, as well as other embodiments, aspects, advantages, and alternatives will become apparent to those of ordinary skill in the art by reading the following detailed description, with reference where appropriate to the accompanying drawings. Further, this summary and other descriptions and figures provided herein are intended to illustrate embodiments by way of example only and, as such, that numerous variations are possible. For instance, structural elements and process steps can be rearranged, combined, distributed, eliminated, or otherwise changed, while remaining within the scope of the embodiments as claimed.

DETAILED DESCRIPTION

Introduction

Figure 1:
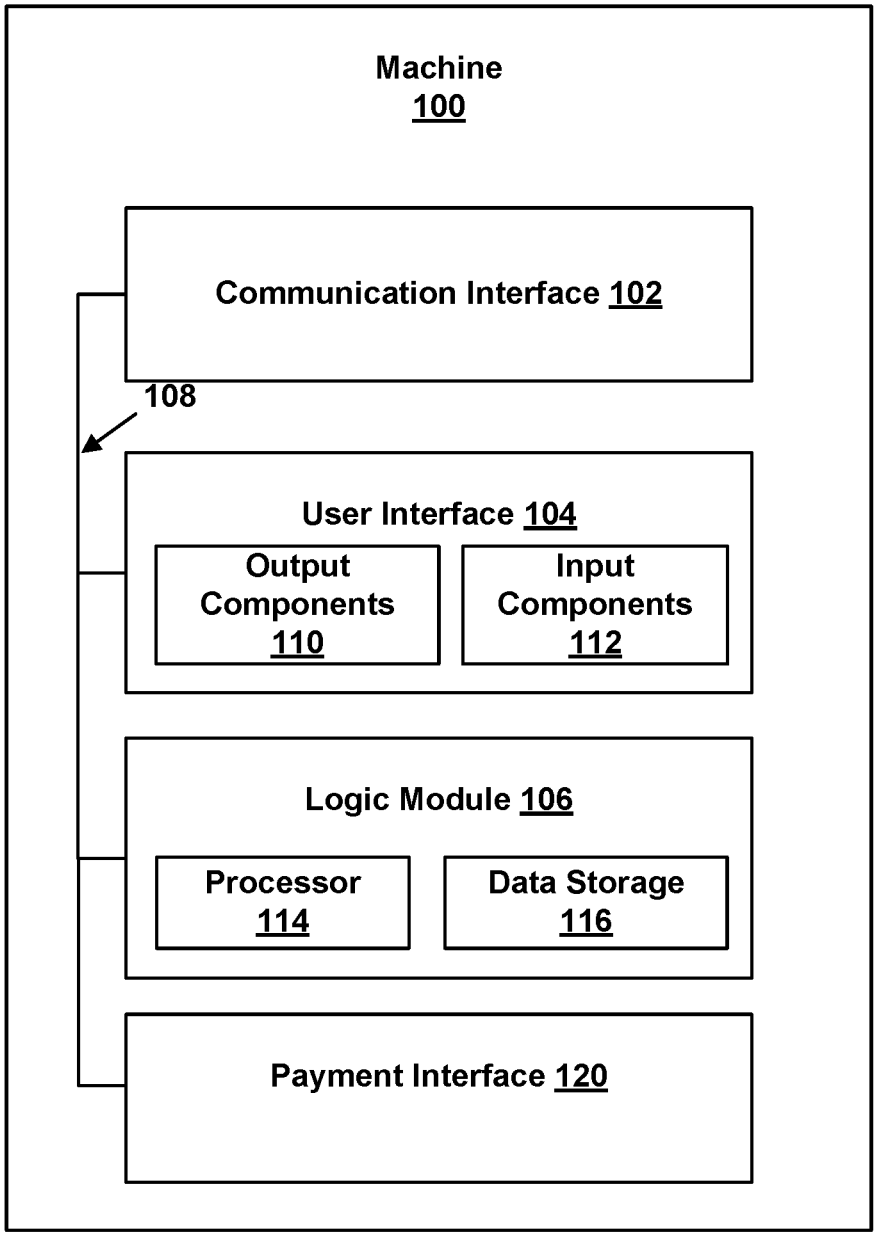
FIG. 1 is a simplified block diagram of a machine, in accordance with example embodiments.

This description describes several example embodiments including, but not limited to, example embodiments pertaining to performing aspects of an outcome event using a gaming machine, such as a slot machine. Performing the outcome event can include playing a game. The machine can display a variety of symbols during performance of an outcome event. A symbol displayed within a symbol-display-portion of a display during an outcome event may be replaced by another symbol. The replacement symbols can be used to determine a payout amount for an outcome event in which a wager is won.

Throughout this description, the articles "a" or "an" are used to introduce elements of the example embodiments. Any reference to "a" or "an" refers to "at least one," and any reference to "the" refers to "the at least one," unless otherwise specified, or unless the context clearly dictates otherwise. The intent of using the conjunction "or" within a described list of at least two terms is to indicate any of the listed terms or any combination of the listed terms.

The use of ordinal numbers such as "first," "second," "third" and so on is to distinguish respective elements rather than to denote a particular order of those elements. For purpose of this description, the terms "multiple" and "a plurality of" refer to "two or more" or "more than one."

Further, unless context suggests otherwise, the features illustrated in each of the figures may be used in combination with one another. Thus, the figures should be generally viewed as component aspects of one or more overall embodiments, with the understanding that not all illustrated features are necessary for each embodiment.

Disclosed herein are machines, systems, and methods for carrying out aspects of outcome events that include displaying symbols. These aspects may be incorporated into games, in particular, wager games. In one aspect, the machines, systems, and methods provide a feature that may enhance traditional wager games (e.g., slot machines or other reel-type games) by providing a player with additional opportunities to win the game, thereby increasing the player's interest, anticipation, and excitement in connection with the game. This may in turn benefit a casino or another entity that provides a game with this feature. Indeed, wager games are typically configured to have odds that favour the casino (sometimes referred to as the "house"). Accordingly, based on the law of averages, casinos often increase their profits simply by getting more players to play more games. Due to the provided features, players may be drawn in (e.g., from competing casinos that lack games with such a feature) and they may play the game often. The feature can include new data communications between a server machine and a client machine within a server-client based configuration.

In particular, a "hot mode" of a wager game and related gaming machines is described herein. The hot mode can be considered as a particular state of a wager game and/or gaming machine. A player can enter into the hot mode state via a triggering mechanism of the gaming machine that acts similarly as a triggering mechanism used to enter into a bonus state or free spin state.

The gaming machine can indicate whether or not the gaming machine is in the hot mode state. For example, one or more images, animations, dialogs, displays, and/or sounds can indicate that the gaming machine is in the hot mode state. When the gaming machine is not in the hot mode state, use of those images, animations, dialogs, displays, and/or sounds can be inhibited and/or one or more other images, animations, dialogs, displays, and/or sounds can indicate that the gaming machine is not in the hot mode state.

One invocation of the hot mode state can last for a number of spins of the gaming machine, which can be a randomly determined number of spins. In some cases, the player is not informed of the number of hot mode spins, as uncertainty about hot mode duration can add to player excitement and enjoyment generated by the gaming machine.

The player must place a wager for each hot mode spin; that is, a hot mode spin is not a free spin. In some examples, a value of the wager remains constant for all spins within one invocation of the hot mode state; i.e., if a wager value changes between hot mode spins, then the gaming machine will exit the hot mode state. In particular of these examples, game states can be stored per bet size. Suppose the hot mode state were to be exited based on a changing a wager value from V1 and V2. Then, if the player returns to wagers of wager value V1, the gaming machine can re-enter the hot mode states for the remaining hot mode spins.

While in the hot mode state, an actual and/or an expected return to player can be over 100%. With an actual RTP over 100%, if the player wagers a sum S1 over one or more hot mode spins, the return to the player for these hot mode spin(s) will equal to or exceed S1. With an expected RTP over 100%, if the player wagers a sum S1 over one or more hot mode spins, the gaming machine may be configured to provide a predicted return to the player for these hot mode spin(s) that equals or exceeds S1, but may not actually equal or exceed S1 due to randomness in the game. Thus, the player of the gaming machine has an interest to keep wagering at least while the gaming machine is in the hot mode state. In some examples, a variety of related features can occur during the hot mode state. Examples of these related features include having reels turning wild, winnings multipliers, and reels that only have symbols that lead to winning wagers. Each of these related features can have RTP's over 100% so that the player knows the hot mode state is likely to be a profitable game state. By putting a gaming machine into a hot mode state, player enjoyment can be enhanced and subsequent player wagering can be increased.

Example Architecture

FIG. 1 shows a simplified block diagram of an example machine 100 arranged to implement operations in accordance with example methods described herein. Machine 100 may take any of a variety of forms, including for example a dedicated gaming machine, a personal computer, a server computer, a personal digital assistant, a mobile phone, a tablet device, or some other computing device.

Machine 100 may include a communication interface 102, a user interface 104, a logic module 106, and a payment interface 120, all of which may be coupled together by a system bus, network, or other connection mechanism 108. The communication interface 102 may include a wired or wireless network communication interface. For purposes of this description, any data described as being provided, sent, or transmitted by machine 100 can be data sent by communication interface 102 over a communication network. Also, for purposes of this description, any data described as being received by machine 100 can be data sent to communication interface 102 over a communication network.

The user interface 104 may facilitate interaction with a user (e.g., a player of a game) as applicable. As such, the user interface 104 may include output components 110 that may take the form of a GUI and may include a speaker and a display, and/or input components 112 such as a keypad, keyboard, mouse, dedicated buttons, a pull handle, and/or a touch-sensitive screen. As described in greater detail below, a display of user interface 104 may be configured to show, among other things, a symbol set in a game or a portion thereof.

The logic module 106 can take the form of a processor 114 and data storage 116. The processor 114 can include a general-purpose processor (e.g., a microprocessor) or a special-purpose processor (e.g., a digital signal processor or an application specific integrated circuit) and may be integrated in whole or in part with the communication interface 102 or the user interface 104. Any processor discussed in this description or shown in the drawings can be referred to as a computer-readable processor. Any data storage discussed in this description or shown in the drawings can be referred to as computer-readable data storage.

Data storage 116 may include volatile or non-volatile storage components and may be integrated in whole or in part with processor 114. Data storage 116 may take the form of a non-transitory computer-readable medium and may include software program instructions, that when executed by processor 114, cause machine 100 to perform one or more of the operations described herein. Any software program instructions discussed in this description or shown in the drawings can be referred to as computer-readable program instructions, or more simply, program instructions.

In some embodiments, machine 100 can include payment interface 120, which can be configured to obtain accept and/or dispense payments. Payments can take the form of coins, currency, printed payment tickets, credit cards, and/or electronic payments. The payments can be accepted and/or dispensed by one or more payment-related devices of payment interface 120. Examples of payment-related devices include, but are not limited to, one or more: bill acceptors, coin acceptors, bill dispensers, coin dispensers, payment ticket printers, payment ticket readers, credit card readers, and electronic payment processing hardware and/or software.

For example, payment interface 120 may include an acceptor of a physical item associated with a monetary value, such as a paper money acceptor, coin acceptor, a payment ticket reader, or a credit, debit, and/or other card reader. This acceptor may include a validator configured to identify the physical item, and determine whether the physical item is suitable as payment to the machine.

Payment interface 120 may also physically dispense a corresponding payout (e.g., cash), or otherwise facilitate the payout to the player (by adding funds to an electronic account associated with a gaming card). Such an activity may be triggered by a cash-out button that is part of user interface 104 or elsewhere on machine 100. Additionally or alternatively to determining the payout amount, machine 100 may perform other actions to award the player. For instance, the machine may display an indication of a tangible prize. Other types of awards may be used as well. Other examples of payment-related device(s) and/or payment interface(s) 120 are possible as well.

In some scenarios, machine 100 can operate as a standalone gaming machine. That is, machine 100 can be utilized to play one or more games of chance, including performing operations such as interacting with the user/player, generating random events, executing software program instructions, accepting payments, dispensing payments, and any other operations required to play the game(s) of chance, without communicating with other computing devices while playing the game(s) of chance. In other scenarios, machine 100 can communicate with other computing devices via one or more computer networks while playing the game(s) of chance via one or more computer networks—examples of these computing devices and networks are discussed with respect to FIG. 2 immediately below.

Figure 2:
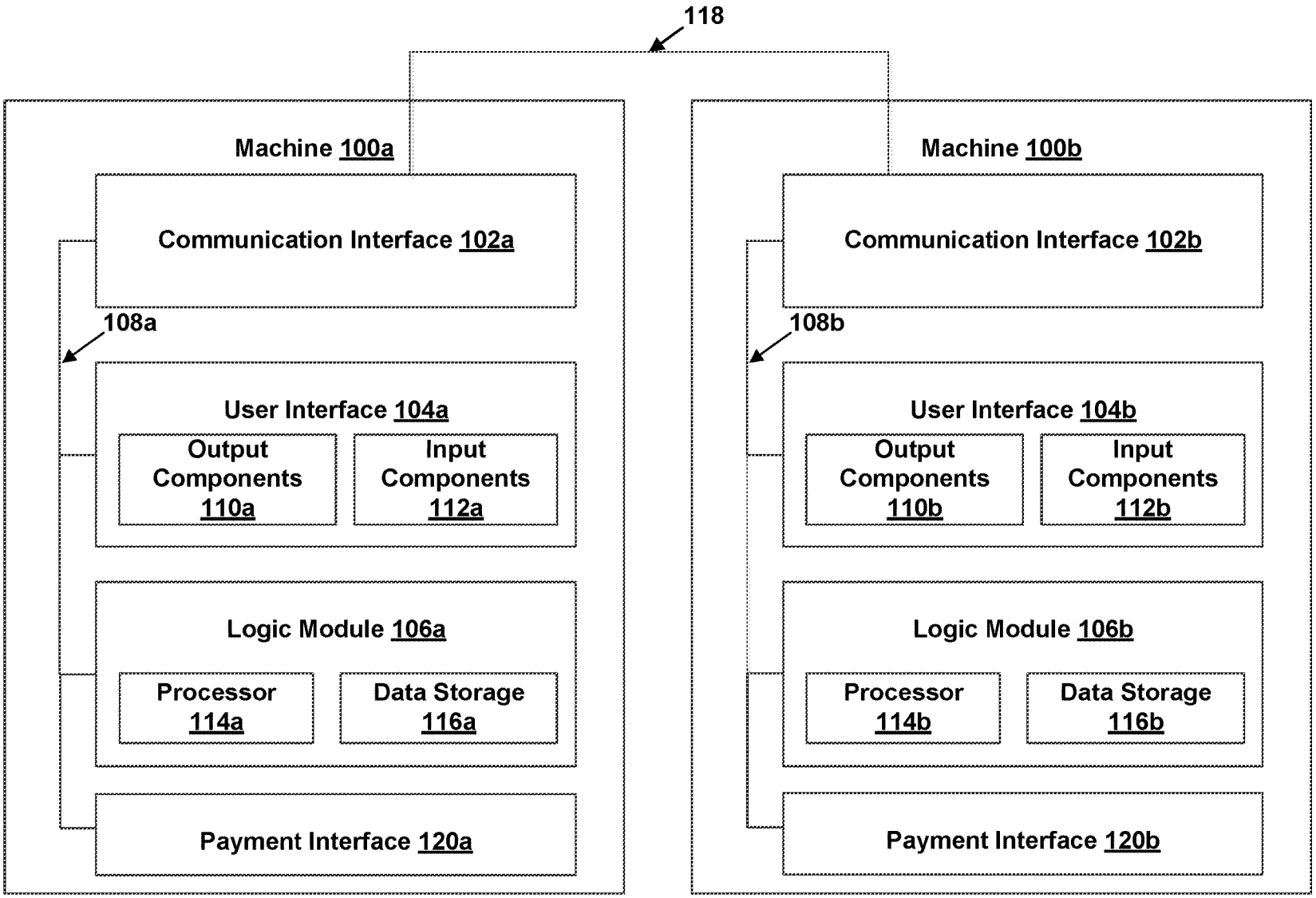
FIG. 2 is a simplified block diagram of an example server machine connected to an example client machine over a computer network, in accordance with example embodiments.

FIG. 2 is a simplified block diagram of an example server machine 100*a* connected to an example client machine (sometimes referred to as a workstation) 100*b* over a communication network 118. A configuration of elements including server machine 100*a* and client machine 100*b* can be referred to as a server-client based configuration.

The components of the server machine 100*a* and the client machine 100*b* are shown with corresponding "a" and "b" reference numerals (i.e., based on machine 100). Server machine 100*a* includes communication interface 102*a*, user interface 104*a* (which includes output components 110*a* and input components 112*a*), logic module 106*a* (which incorporates processor 114*a* and data storage 116*a*), payment interface 120*a*, and communication bus 108*a*. Likewise, client machine 100*b* includes communication interface 102*b*, user interface 104*b* (which includes output components 110*b* and input components 112*b*), logic module 106*b* (which incorporates processor 114*b* and data storage 116*b*), payment interface 120*b*, and communication bus 108*b*. In some embodiments, machine 100*a* does not include payment interface 120*a* and/or machine 100*b* does not include payment interface 120*b*.

The server machine 100*a* is configured to communicate with the client machine 100*b* over communication network 118 (via the communication interfaces 102*a*, 102*b*). Likewise, the client machine 100*b* is configured to communicate with the server machine 100*a* over the communication network 118. For purposes of this description, any data described as being sent or transmitted by the server machine 100*a* can be data sent by communication interface 102*a* over communication network 118. Similarly, any data described as being sent or transmitted by the client machine 100*b* can be data sent by communication interface 102*b* over communication network 118. Furthermore, for purposes of this description, any data described as being received by the server machine 100*a* can be data the server machine 100*a* receives from the communication network 118 using communication interface 102*a*. Similarly, any data described as being received by the client machine 100*b* can be data the client machine 100*b* receives from the communication network 118 using communication interface 102*b*.

The communication network 118 for the server-client based configuration described above may take a variety of forms. For example, the communication network 118 may be a local area network (LAN) in a casino, such that client machines 100*b* dispersed throughout the casino may communicate with the server machine 100*a* in the casino.

In another example, the communication network 118 may be a wide-area network (WAN), such as an Internet network or a network of the World Wide Web. In such a configuration, the client machine 100*b* may communicate with the server machine 100*a* via a website portal (for a virtual casino) hosted on the server machine 100*a*. The data described herein as being transmitted by server machine 100*a* to client machine 100*b* or by client machine 100*b* to server machine 100*a* can be transmitted as datagrams according to the user datagram protocol (UDP), the transmission control protocol (TCP), or another protocol.

The communication network 118 may include any of a variety of network topologies and network devices, and may employ traditional network-related technologies, including for example the public switched telephone network, cable networks, cellular wireless networks, WiFi, and WiMAX. Further, the communication network 118 may include one or more databases (e.g., a player credit account database), to allow for the storing and retrieving of data related to performing an outcome event by a machine, as well as adjusting account balances associated with client machines.

For purposes of this description, any operation listed in a sentence including the words the "machine 100 can cause," the "server machine 100*a* can cause," or the "client machine 100*b* can cause" can be carried out, at least in part, as a result of that particular machine executing software program instructions. Those software program instructions can be stored within data storage 114, 114*a*, or 114*b*.

Data storage 114, 114*a*, and 114*b* can also store data. As an example, a global symbol group for a reel-based game may include multiple symbols, such as a WILD symbol, a HOT MODE symbol, an ace, a king, a queen, a jack and a ten that may be used in connection with the outcome event, such as a wager game. The ace, king, queen, jack and ten symbols can represent symbols found on a standard deck of playing cards. The WILD symbol may have special properties that allow it to form winning combinations with other symbols. The HOT MODE symbol may indicate that the gaming machine could be in a hot mode state during one or more upcoming turns.

However, such a global symbol group may be customized with particular symbols as desired. As some possible examples, the symbols may include images of people, animals, dinosaurs, fanciful creatures, cartoon characters, inanimate objects, or other things in addition to or instead of WILD, HOT MODE, ace, king, queen, jack, or ten symbols. Furthermore, WILD and/or HOT MODE symbols may vary in design. Examples of some possible symbols are shown in the accompanying drawings.

Figure 3:
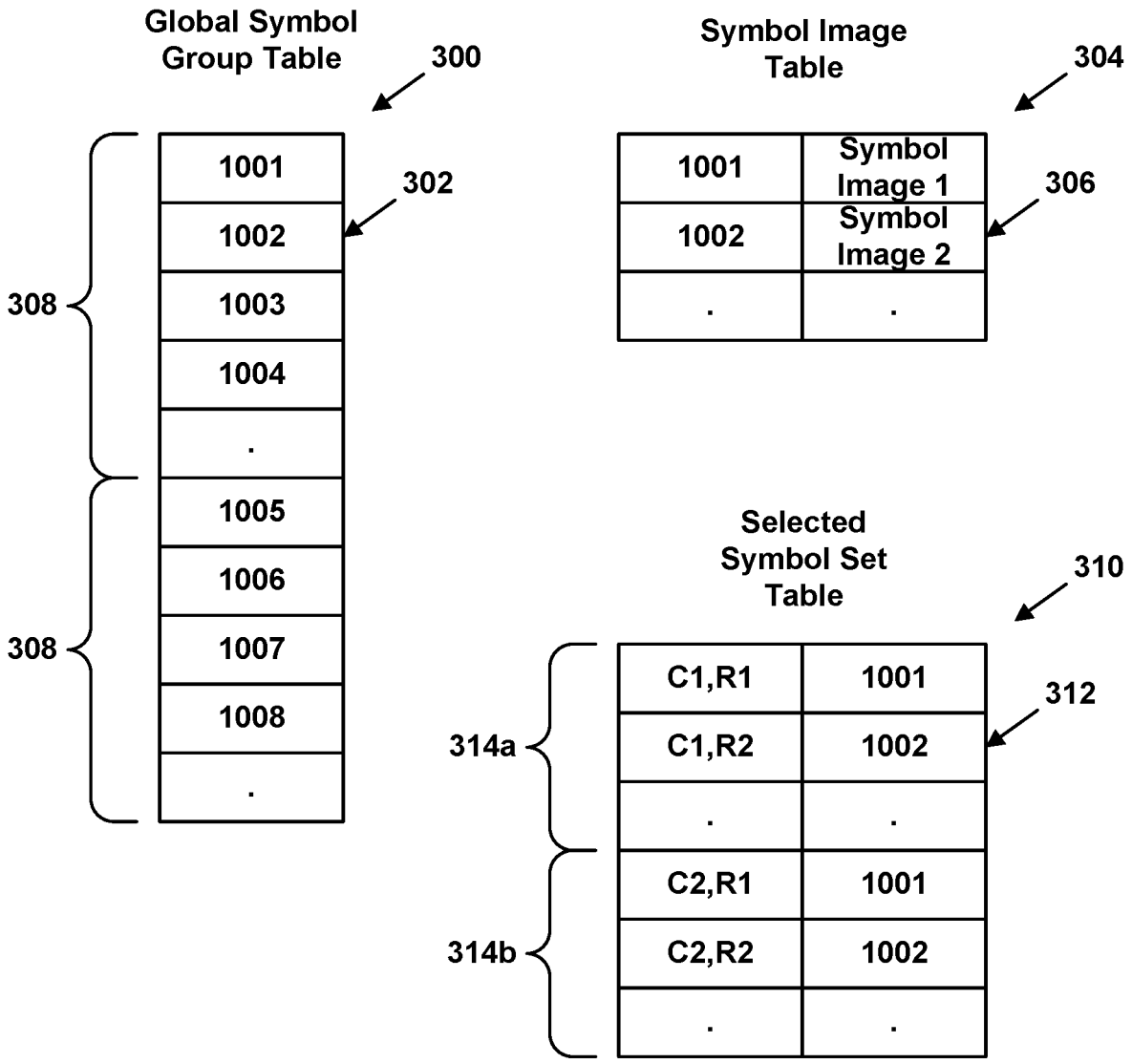
FIG. 3 depicts diagrams of tables that may be used with the processes, machines, and systems herein, in accordance with example embodiments.

In one example, the global symbol group may be represented as a table (or other data structure) stored in data storage 114. FIG. 3 shows an example global symbol group table 300. The global symbol group table 300 includes multiple records 302, each including an identifier (e.g., 1001, 1002, 1003 1004, etc.) that represents a particular symbol. In one example, the global symbol group, and therefore the global symbol group table 300, may be divided into multiple sub-groups 308 as discussed in greater detail below.

The global symbol group table 300 may be used in connection with a symbol image table 304. The symbol image table 304 includes multiple records 306 (shown as distinct rows of table 304), each including an identifier that represents a particular symbol, and a corresponding displayable image. As such, the symbol image table 304 may be used to map an identifier in the global symbol group table 300 to a displayable image. Such an image may be arranged according to the Joint Photographic Experts Group (JPEG), Graphics Interchange Format (GIF), or Portable Network Graphics (PNG) encodings, for example.

During the course of a game, various symbol sets may be selected for display. Each selected symbol set may be stored in a table such as selected symbol set table 310. Selected symbol set table 310 includes multiple records 312 (shown as distinct rows in selected symbol set table 310), each record including an arrangement position of the symbol, and an identifier that represents the symbol. As such, each symbol in the selected symbol set may correspond with a respective arrangement position in a display arrangement (e.g., both a column number and a row number in a column-and-row arrangement). As an example, C1, R1, shown in the selected symbol set table 310, represents a symbol position at column 1 (e.g., a left-most column of a plurality of columns in a symbol-display-portion of a display of user interface 104) and row 1 (e.g., a top row of a plurality of rows in a symbol-display-portion of a display of user interface 104). The column identifiers in selected symbol set table 310 (e.g., C1 and C2) can refer to columns in a symbol matrix or reels of a plurality of reels that can be spun.

The symbol sets can be organized based on the display arrangement. For example, selected symbol set table 310 is organized to first include a group of symbols 314*a* for the first column of the display arrangement; e.g., each symbol in group of symbols 314 has a "C1" annotation, indicating the symbol is in the first column of the display arrangement. Following group of symbols 314, selected symbol set table 310 next includes group of symbols 314*b* for the second column of the display arrangement; e.g., each symbol in group 314*b* has a "C2" annotation, indicating the symbol is in the second column of the display arrangement. Selected symbol set table 310 can then continue with symbols for other columns of the display arrangement. Other organizations of symbol sets based on display arrangements are possible as well; e.g., an organization of selected symbol set table 310 can be on a per-row basis rather than the above-mentioned per-column basis.

In one example, machine 100 may select the first symbol set by iterating through each record 312 in the selected symbol set table 310, and selecting a symbol identifier from among the symbol identifiers in the global symbol group table 300. In some examples, the symbol identifiers are numbers and machine 100 uses a random number generator to select such numbers, and therefore to randomly select symbols.

In some examples, machine 100 may select each subset in the first symbol set from the corresponding sub-group in the global symbol group. This type of selection may be used when the symbol set represents one or more reels in a reel-type wager game. In this instance, each sub-group includes all the symbols of a given reel, and the selected sub-set includes the symbols of the reel that are "in play," namely those included in the selected symbol set.

In some examples, the selected subset may be partially restricted. For instance, the selected symbol set may include an instance of a predetermined symbol from the global symbol group, for example, a HOT MODE symbol. In another example, the predetermined symbol may be in a subgroup of global symbol group table 300 distinct from the subgroups from which symbols for the reels are selected.

As noted above, for each symbol in the selected first symbol set, the example embodiments can include machine 100 randomly determining a corresponding arrangement position. As such, in an example where the arrangement is a column-and-row arrangement, machine 100 may randomly determine a column identifier and a row identifier (from a set of potential column identifier and row identifier combinations) for each symbol in the selected first symbol set. In an example where the arrangement has symbol position identifiers (e.g., whole number 1 through 15, inclusive, as described above), machine 100 may randomly select a symbol position identifier for each symbol in the selected first symbol set.

Where the column and row arrangement is used to simulate reels, machine 100 may display the each subset in a corresponding column, such as by superimposing each subset over a virtual reel in a corresponding column. Thus, a sub-group 308 may represent an ordering of symbols on a particular reel.

Figure 4:
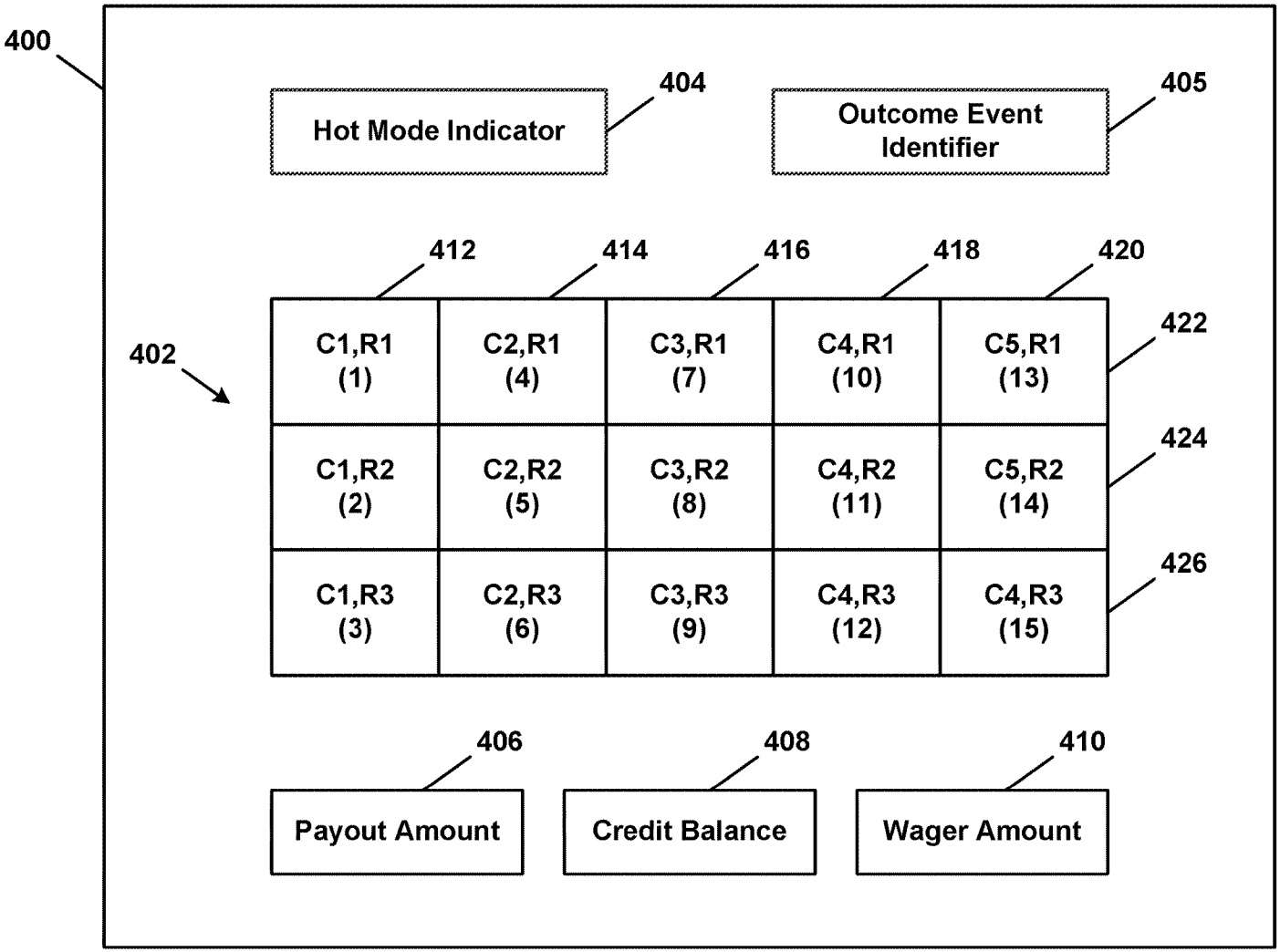
FIG. 4 depicts elements displayable by a display of a machine, in accordance with example embodiments.

FIG. 4 depicts a screenshot 400 that machine 100, server machine 100*a*, or client machine 100*b* can visually present (i.e., display) using displays 110, 110*a*, and 110*b*, respectively. For purposes of this description, each element of screenshot 400 can be a displayable element of the display. Screenshot 400 includes a symbol-display-portion 402, a hot mode indicator 404, an outcome event identifier 405, a payout amount indicator 406, a credit balance indicator 408, and a wager amount indicator 410.

Symbol-display-portion 402 can include multiple symbol-display-segments and multiple symbol positions. As an example, the symbol-display-segments can include vertical symbol-display-segments 412, 414, 416, 418, and 420 (or more simply, vertical SDSs 412-420). As another example, the symbol-display-segments can include horizontal symbol-display-segments 422, 424, and 426 (or more simply, horizontal SDSs 422-426). Each symbol-display-segment can include multiple symbol positions. The vertical SDSs 412-420 are shown in FIG. 4 as having three symbol positions. The horizontal SDSs 422-426 are shown in FIG. 4 as having five symbol positions. A person skilled in the art will understand that those symbol-display-segments can be configured with different numbers of symbol positions than shown in FIG. 4.

The vertical SDSs 412-420 can be configured as spinnable reels. The processor of a machine or system displaying screenshot 400 can display the spinnable reels spinning and stopped after spinning. For vertical SDSs 412-420, the spinnable reels may spin in a vertical direction (e.g., top to bottom or bottom to top, with respect to the symbol-display-portion 402).

The horizontal SDSs 422-426 can be configured as spinnable reels. The processor of a machine or system displaying screenshot 400 can display the spinnable reels spinning and stopped after spinning. For horizontal SDSs 422-426, the spinnable reels may spin in a horizontal direction (e.g., left to right or right to left, with respect to the symbol-display-portion 402).

Machine 100 can cause symbol-display-segments to spin, and to cause spinning symbol-display-segments to stop spinning. The spinning and stopping of the spinning symbol-display-segments can be carried out for each outcome event. In accordance with the embodiments in which the symbol-display-portion 402 includes columns or reels that spin from top to bottom or bottom to top, spinning the reels can include starting the spinning from a left-most column or reel to a right-most column or reel. Stopping the reels can occur using a similar sequence. Other sequences of spinning and stopping the spinning can be used. Moreover, the spinning or stopping of spinning of two or more columns or reels could occur simultaneously.

The multiple symbol positions in symbol-display-portion 402 are identified by column and row designators, in which C1=column 1, C2=column 2, C3=column 3, C4=column 4, C5=column 5, R1=row 1, R2=row 2, and R3=row 3. The multiple symbol positions in symbol-display-portion 402 are also identified by distinct numerical identifiers shown within parenthesis. C1 can be a first SDS. C2 can be a second SDS. C3 can be a third SDS. C4 can be a fourth SDS. C5 can be a fifth SDS. As shown in FIG. 4, C2 is between C1 and C3, C3 is between C2 and C4, and C4 is between C3 and C5.

For a matrix arrangement with 15 symbol positions as shown in FIG. 4, the numerical identifiers can be whole numbers 1 through 15, inclusive. The processors or machines described herein can be configured to select a symbol position of symbol-display-portion 402 using a random number generator that is configured to generate a number within the range 1 through N, inclusive, where N equals the number of symbol positions in symbol-display-portion 402. For the matrix arrangement, each symbol-display-segment can be a distinct column of the multiple columns within the matrix. Alternatively, for the matrix arrangement, each symbol-display-segment can be a distinct row of the multiple rows within the matrix.

The processor of the machines or systems described herein can determine a state the machine or system is operating in or an outcome event that can occur during the determined state of the machine or system. Example outcome events include, but are not limited to, a base outcome event, a bonus outcome event; e.g., entering into a bonus state, exiting the bonus state, winning one or more free spins, and a hot mode outcome event; e.g., entering into a hot mode state, exiting the hot mode state.

In response to making that determination, the processor can cause hot mode indicator 404 and/or outcome event identifier 405 to display results of an outcome event that can occur during the determined state. For example, hot mode indicator 404 can indicate whether or not the machine or system is in a hot mode state. In other examples, hot mode indicator 404 can also indicate whether or not the machine or system is in a bonus state and/or a free spin state. In still other examples, hot mode indicator 404 can indicate a number of hot mode spins available to the player; while in even other examples, a display based on screenshot 400, including a display of hot mode indicator 404, does not disclose the number of hot mode spins available to the player; i.e., the display hides information about the number of hot mode spins available to the player.

Outcome event identifier 405 can indicate a number of free spins available while in the bonus state, in a free spin state, or some other state.

In some examples, the hot mode event can be identified based on the outcome event; e.g., an outcome where one or more HOT MODE symbols are displayed in symbol-display portion 402. In other examples, the hot mode event can be identified independently of the outcome event; e.g., the hot mode event can be identified based on one or more of: a random value unrelated to the outcome event, a predetermined number of spins since the last hot mode event, a wager amount, performance of a player (i.e., the hot mode event can be identified if the player wins or loses a predetermined amount or predetermined percentage of the time), and one or more other criteria for identifying hot mode events.

The processor of the machines or systems described herein can determine a wager amount placed on an outcome event, a payout amount after or during occurrence of an outcome event resulting in a win, a credit balance after or while decreasing a number of credits based on placement of a wager or after or while increasing a number of credits based on a determined payout amount. The processor can cause the determined wager amount to be displayed by the wager amount indicator 410, the determined payout amount to be displayed by the payout amount indicator 406, the determined credit balance to be displayed by the credit balance indicator 408.

Figure 5:
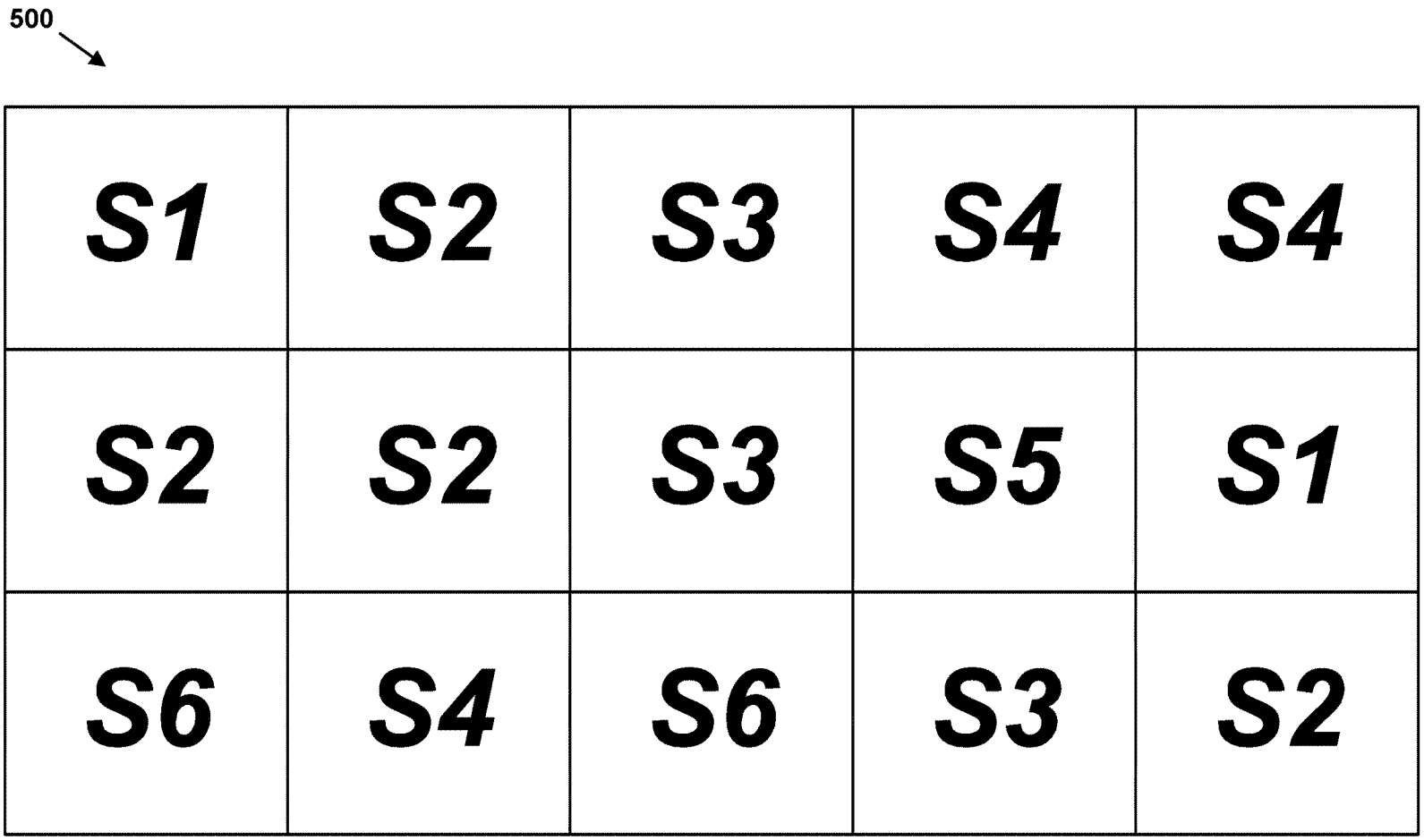
FIG. 5 depicts an example of a selected symbol set in a display, in accordance with example embodiments.

FIG. 5 shows an example of a selected symbol set 500 from the global symbol group for display during a base or bonus outcome event. The selected symbol set 500 includes (i) symbol S1 at arrangement positions C1,R1 and C5,R2, (ii) symbol S2 at arrangement positions C2,R1, C1,R2, C2,R2, and C5,R3, (iii) symbol S3 at arrangement positions C3,R1, C3,R2, and C4,R3, (iv) symbol S4 at arrangement positions C4,R1, C5,R1, and C2,R3, (v) symbol S5 at arrangement position C4,R2, and (vi) symbol S6 at arrangement positions C1,R3 and C3,R3. Other arrangements of symbols, in terms of the number of columns, number of rows, or the layout of symbols, are possible.

Example Reel-Based Hot Mode Game

Figure 6A:
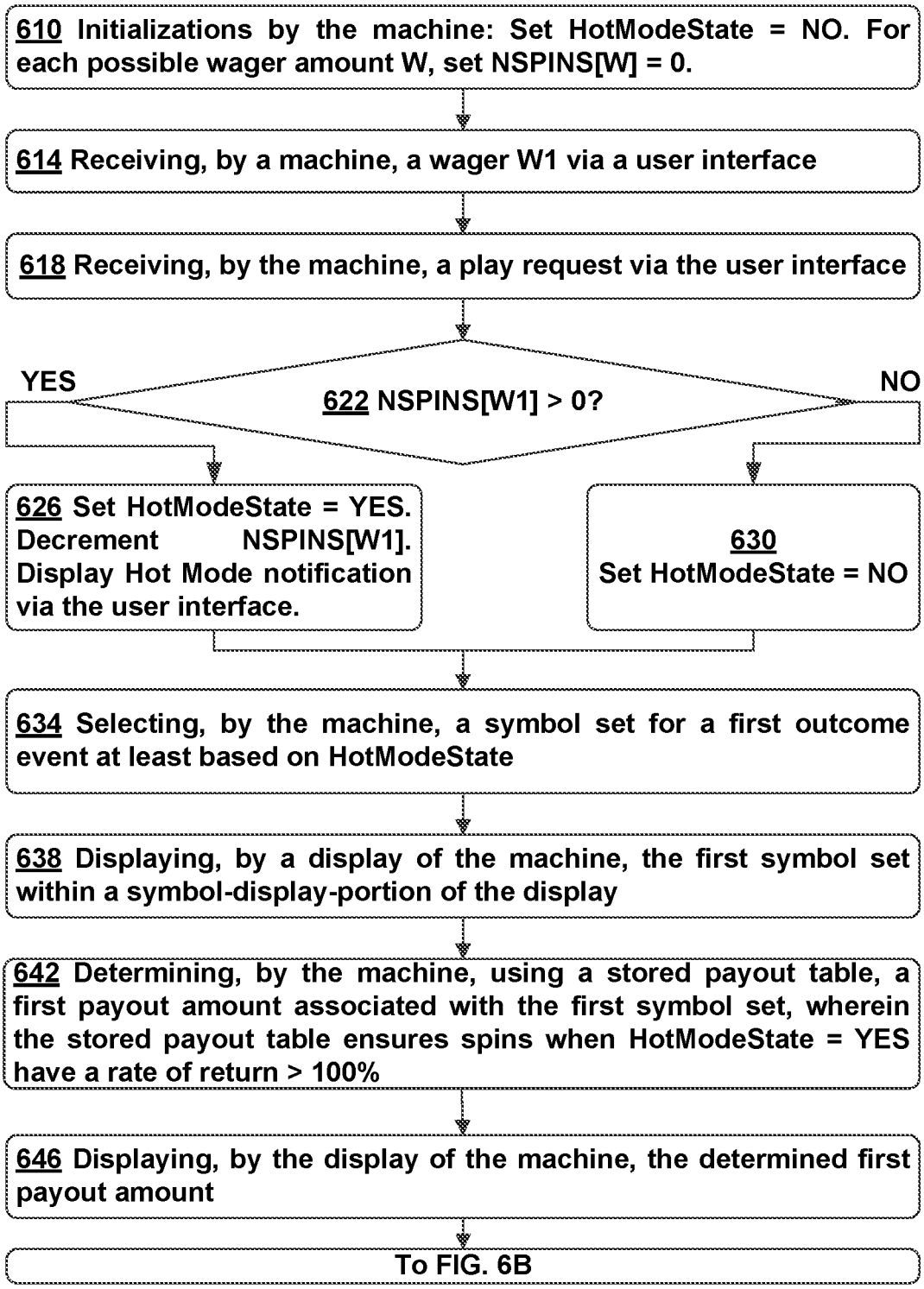
FIGS. 6A and 6B show a flow chart for a method of conducting a gaming session having a hot mode, in accordance with example embodiments.
Figure 6B:
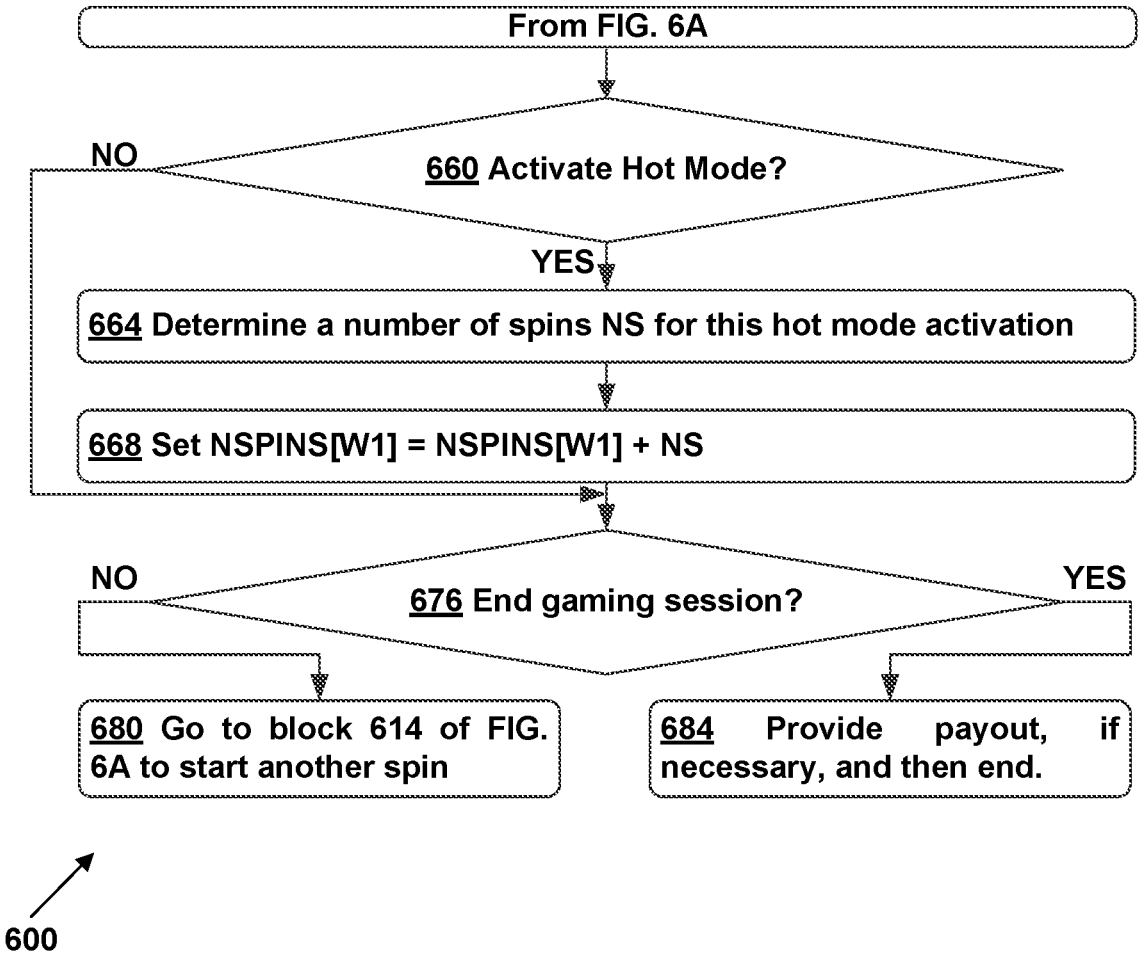

FIGS. 6A and 6B depict a flow chart showing set of operations 600 (or more simply, "set 600") that can, for example, be carried out using machine 100. Nonetheless, some or all of these operations may be carried out on server machine 100*a* and/or client machine 100*b*. The operations of set 600 can pertain to a method in connection with machine 100. The example method can relate to performing outcome events, such as a wager game. In particular, set 600 can be used by machine 100 to conduct a gaming session having a hot mode, where a gaming session can involve one or more plays of the wager game. Any other operation(s) described herein as being performed by machine 100 can be performed prior to, while, or after performing any one or more of the operations of set 600, unless context clearly dictates otherwise. Those other operation(s) can be performed in combination with or separately from any one or more of the operations of set 600. Any operation described below, or elsewhere in this description, with respect to FIGS. 6A and 6B, can be performed, at least in part, by a processor, such as processor 112 executing software program instructions.

Turning to FIG. 6A, set 600 can begin at block 610, which includes initializations of a Boolean (or similar) variable HotModeState and a numeric array (or similar data structure) of values NSPINS. The herein-described HotModeState and NSPINS variables are part of example embodiments of set 600; other embodiments of set 600 can use different data and/or variables than described herein.

The HotModeState variable can be set to YES (i.e., 1 or TRUE in other embodiments of Boolean variables) if machine 100 is in a hot mode state or be set to NO (i.e., 0 or FALSE in other embodiments of Boolean variables) if machine 100 is not in a hot mode state; e.g., machine 100 is in the normal state. The NSPINS array can include storage for at least each possible wager amount—for example, if machine 100 can accept wagers of 1, 2, 3, 4, and 5 credits per wager game, then the total number of possible wager amounts is 5, and so NSPINS in this example can have storage for at least 5 numeric values.

Each value of the NSPINS array can indicate a number of hot mode spins available for a particular wager value. For example, suppose machine 100 accepts wagers of one, two, or three credits, and the NSPINS array has the following values: NSPINS[1]=0, NSPINS[2]=2, and NSPINS[3]=1. These values of NSPINS indicate that there are: no hot mode spins available for wagers of one credit, two hot mode spins available for wagers of two credits, and one hot mode spin available for wagers of three credits.

During block 610, HotModeState is initialized to NO, and each of the NSPINS numeric values is initialized to 0, indicating that there are no hot spins initially available for any possible wager amount. In other examples, other data can be used and/or initialized as part of set 600.

At block 614, machine 100 can receive a wager W1 via user interface 104. In one example, this may allow a player to enter a wager (e.g., a wager amount) using a keypad of the user interface 104. The wager can be placed on an outcome event, such as, but not limited to, a base outcome event configured as a wager game. The received wager may or may not provide a user of the machine with an opportunity to earn (e.g., win) a payout. Since a received wager does not necessarily provide an opportunity to earn a payout, the received wager can be referred to as a payment. A base outcome event can be carried out after or in response to receiving a payment. Machine 100 can be configured such that a bonus outcome event can be carried out without receiving any additional payment after receiving a payment to carry out a base outcome event resulting in an award of a predetermined number of bonus outcome events.

A player using machine 100 may have a corresponding player credit balance from which the entered wager may be deducted in response to the wager being entered or machine 100 receiving a play request from the player. For example, a player may have a player credit balance of 100,000 credits, which may be reduced to 99,750 credits upon the player requesting a play of the game with a wager of 250 credits. Additionally, or alternatively, the wager can be received by entry of a token, coin, or paper bill into the user interface 104 or by sliding or inserting a payment card, such as a credit or debit card, into the user interface 104. Machine 100 can cause a display of user interface 104 to display wager information such as, but not limited to, a player credit balance on the credit balance indicator 408, one of the possible wager amounts in wager amount indicator 410, and a received wager amount in wager amount indicator 410.

At block 618, machine 100 can receive a play request (e.g., a "spin" request) via the user interface 104. Receiving the play request may involve or allow a player to pull a lever or push a button on machine 100 to initiate occurrence of an outcome event or to request a play of the wager game. Receiving the play request can result in the player's credit balance being reduced by an amount of the player's wager or payment to carry out the outcome event.

At block 622, machine 100 can determine whether the value of WSPINS[W1] is greater than 0; that is, if there are any hot mode spins available for the current wager amount W1. If WSPINS[W1] is greater than 0, machine 100 can proceed to block 626; otherwise, WSPINS[W1] is equal to 0, and machine 100 can proceed to block 630.

At block 626, machine 100 can set the value of the HotModeState variable to YES, indicating machine 100 is in a hot mode state. Machine 100 can also decrement WSPINS [W1] to reduce the number of hot mode spins available for the current wager amount by one. Additionally, machine 100 can display a notification that machine 100 is in the hot mode state via a user interface of machine 100; e.g., using hot mode indicator 404. Upon completion of the procedures of block 626, machine 600 can proceed to block 634.

At block 630, machine 100 can set the value of the HotModeState variable to NO, indicating machine 100 is not in a hot mode state. Upon completion of the procedures of block 630, machine 600 can proceed to block 634.

At block 634, machine 100 can select, a symbol set to display within the symbol-display-portion 402 of a display of user interface 104 for a first outcome event. The selection of the symbol set can be based on whether or not machine 100 is in the hot mode state. If machine 100 is not in the hot mode state, processor 112 can carry out a random selection, such as a random selection of a selected symbol set from a global symbol group, as described with respect to FIG. 3. And, in some embodiments, even when machine 100 is in the hot mode state, the symbol set can be randomly selected as for a base outcome event or a bonus outcome event. But, in other embodiments, when machine 100 is in the hot mode state, then a hot-mode-specific symbol set can be selected as the selected symbol set in some embodiments, such as discussed below in the context of FIG. 9B.

Figure 9A:
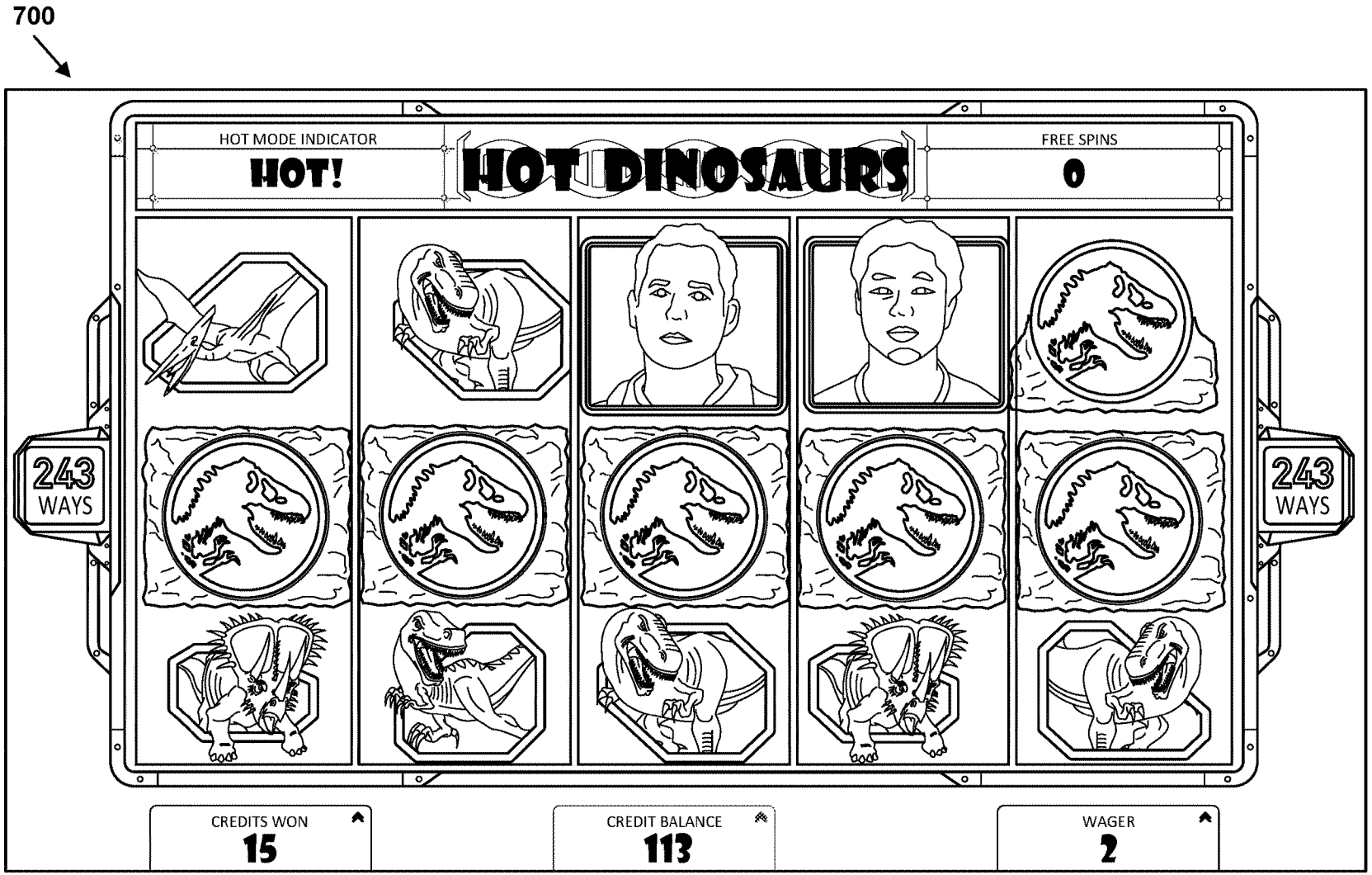
FIG. 9A shows one example of a third display of a gaming session scenario, in accordance with example embodiments.
Figure 9B:
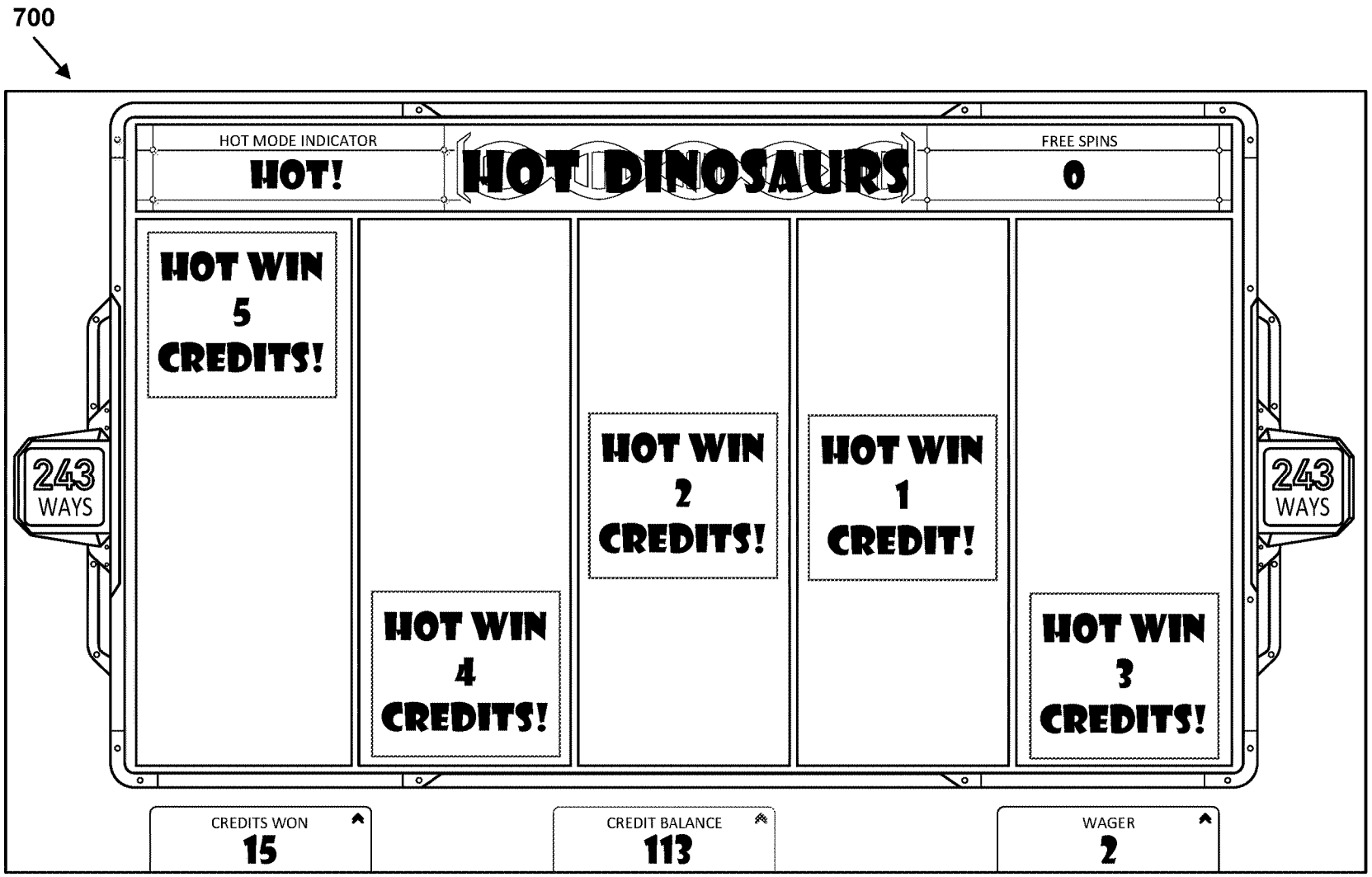
FIG. 9B shows another example of a third display of a gaming session scenario, in accordance with example embodiments.

At block 638, machine 100 can display on the symbol-display-portion of a display of user interface 104, the selected symbol set. FIG. 5 shows an example of symbol set 500 from the global symbol group for display during a base outcome event. FIG. 9B, described below in more detail, shows an example hot-mode specific symbol set in the context of scenario 700.

At block 642, machine 100 can determine, using a stored payout table (not shown), a first payout amount, where the first payout amount is a function of the selected first symbol set, the received wager, and the HotModeState variable. Processor 112 can execute program instructions to determine whether a payout is earned (e.g., won) as a result of each outcome event occurring at machine 100. If a payout is not earned, the payout amount can be zero. If a payout is earned, the payout amount can be a function of the received wager and the symbol set selected for the outcome event (e.g., the first symbol set selected for the first outcome event) or the corresponding arrangements of symbols in the selected first symbol set In particular, if HotModeState=YES (i.e., machine 100 is in a hot mode state), the payout amount is selected so that the player has a hot-mode-state rate of return greater than 100%. Generally, a rate of return to the player over a number of wagers NW can be determined as a ratio RoR as shown in Equation (1):

$$RoR = \frac{\sum_{i=1}^{NW} \text{payout}(i)}{\sum_{i=1}^{NW} \text{wager}(i)}. \tag{1}$$

where payout(i)=a payout amount for wager i, wager(i) is an amount wagered for wager i, and i is a value in the range [1, NW].

For example, suppose a player made three wagers of one credit at a gaming machine in a hot mode state, and won one credit on the first wager, won zero credits on the second wager, and won three credits on the third wager. Then, for this example, Equation (1) indicates $$RoR = \frac{1+0+3}{1+1+1} = \frac{4}{3},$$

or expressed as a percentage, RoR=133.3%. Thus, even if some bets in a series of bets do not win, such as the second bet in this example, a player's rate of return (RoR) over the series of bets can be greater than 100%.

As another example, suppose a player made three wagers of one credit at a gaming machine in normal state, and won one credit on the first wager, won zero credits on the second wager, and won one credit on the third wager. Then, for this example, Equation (1) indicates $$RoR = \frac{1+0+1}{1+1+1} = \frac{2}{3},$$

or expressed as a percentage, RoR=66.7%. That is, a RoR while in the normal state can be less than 100% and/or less than a RoR while in the hot mode state.

A player's RoR will be greater than 100% for a series of NW wagers in a hot mode state, NW>0, if Inequality (2) below is satisfied:

$$\sum_{i=1}^{NW} \text{payout}(i) > \sum_{i=1}^{NW} \text{wager}(i) \tag{2}$$

As such, when the HotModeState variable=YES, a payout table selected at block 642 has yield payout values that satisfy Inequality (2) above. In some examples, each wager during a hot mode has to be the same size; for example, each wager has to be of size SW, with SW>0. Then, assuming each wager(i) value=SW, Inequality (2) can be simplified for NW wagers in the hot mode state to reach Inequality (3):

$$\sum_{i=1}^{NW} \text{payout}(i) > NW * SW \tag{3}$$

Thus, in the example each wager(i) value=SW, the payout table can be selected to ensure the sum of NW hot mode payouts is greater than NW*SW.

In some examples, the hot mode RoR can be an expected RoR that is greater than 100%. The expected RoR can be achieved, for example, by altering the symbol composition of the reels during hot mode, or by employing a different, more favourable, pay table. However, this expected RoR can be subject to randomness and so an actual RoR may fall below 100% in these examples; i.e., Inequalities (2) and (3) may not be satisfied. In these examples, the expected RoR can be greater than 100%, but the random nature of the game may well result in the hot mode state terminating without a guaranteed profit to the player.

To illustrate the difference between actual and expected RoR, suppose that a hot mode RoR on gaming machine GM1 has an actual hot mode RoR1, RoR1=110%, and the hot mode RoR on gaming machine GM2 is set to an expected hot mode RoR2, RoR2=110%. Let both GM1 and GM2 enter into the hot mode state for 10 spins with a hot mode wager size of 2 credits. As such, the expected return to the player on both GM1 and GM2 is 10 spins*2 credits/spin*110% RoR=22 credits. Further, let each of GM1 and GM2 return 17 total credits to a respective player for the first 9 hot mode spins due to the randomness of the game. As such, after the first 9 spins, both GM1 and GM2 have a hot mode RoR=17/18=94.4%, which is less than 100%. Then, in the final hot mode spin for gaming machine GM1, GM1 will return at least 3 credits to the player to ensure the player had an actual RoR of at least 100%, and in some examples, GM1 will return at least 5 credits to the player to ensure the player had an actual RoR of at least 110%. However, in the final hot mode spin for gaming machine GM2, GM2 will return an expected value of 2.2 credits and may return less than 3 credits (which would provide the player with a RoR=100%); therefore, the player's actual return from GM2 may be less than 100%.

However, if HotModeState=NO (i.e., machine 100 is in not in a hot mode state), a payout can be selected based on a different rate of return selected when machine 100 is in the hot mode state. For example, if machine 100 is in a normal state, the payout can be selected based on a normal-state rate of return that is less than the hot-mode-state as discussed above in the context of Equation (1). As a specific example, a hot-mode-state rate of return could be 150% (or another percentage greater than 100%) while a normal-state rate of return could be 85% (or another percentage less than the hot-mode state of return).

At block 646, machine 100 can display, by a display of user interface 104 of machine 100, the determined first payout amount. For example, where machine 100 has determined, using the stored payout table, a first payout amount of 500 credits, machine 100 may display on a display of user interface 104 the determined payout amount of 500 credits. Additionally or alternatively, machine 100 may add the determined payout amount to the player credit balance and display the updated player credit balance. For instance, where the player credit balance was 99,750 credits before the payout amount was determined, machine 100 may add the determined payout amount of 500 credits to the player credit balance so that the updated balance is 100,250 credits. Furthermore, machine 100 can cause a display of user interface 104 to display a count-up from a first balance amount (e.g., 99,750 credits) to a second balance amount (e.g., 100,250 credits), where the second balance amount equals a sum of the first balance amount and the determined payout amount.

Turning to FIG. 6B, at block 660, machine 100 can determine whether or not to activate the hot mode state; that is, put machine 100 into a hot mode state, perhaps from the normal state. For example, machine 100 can determine to activate hot mode based on one or more hot-mode-activation events. The hot-mode-activation events can include, but are not limited to: an event where a particular random value occurs, an event that randomly occurs during performance of at least some base outcome events that is/are determined to be hot-mode-entry event(s), an event that randomly occurs during performance of at least some bonus outcome events, an event of a predetermined number of wagers accepted and/or spins played during one gaming session, an event of a number of wagers accepted and/or spins played since the last hot mode activation, and an event based on a rate of return during a gaming session; e.g., if the rate of return exceeds an low-hot-mode-entry threshold value and/or is less than a low-hot-mode-entry threshold value, a rate of return for machine 100 over some period of time. In some cases, machine 100 can be in the normal state when one or more hot-mode-activation events occur; then, after the hot-mode-activation event(s) occur(s), machine 100 can change from the normal state to the hot mode state.

An example of a base and/or bonus outcome event that can be determined to be a hot-mode-entry event is an event where the first symbol set includes at least one hot mode symbol, such as in connection with a previous play of the game (e.g., a base and/or bonus outcome event). Similar to the selection of the first symbol set, in one example, machine 100 may use a random number generator to select hot mode symbols and perhaps other symbols from the global symbol group.

If machine 100 determines to activate a hot mode state (or, in some cases, maintain an already-entered hot mode state), then machine 100 can proceed to block 664. Otherwise, if machine 100 determines not to activate the hot mode state (or, in some cases, not to maintain an already-entered hot mode state), then machine 100 can proceed to block 676.

At block 664, machine 100 can determine a number of spins NS for the hot mode activation determined at block 660. NS can be determined based on a random value, a predetermined value, based on one or more mathematical formulas, and/or combinations thereof; e.g., NS can be determined as a random value in a range [A, B], where A and B can be predetermined values, determined based on one or more mathematical formulas, and/or combinations thereof. For example, NS can be a number randomly selected from the range [1, 5]. As another example, NS can be a number randomly or otherwise selected from the range [1, 2*max (SPINS_SINCE_HOT/100, 1.5)], where SPINS_SINCE_HOT can be a number of spins since a last hot mode activation; thus, an upper bound on this range will be at least 3 (since even if SPINS_SINCE_HOT=0, 2*max(0, 1.5)=3 Many other examples of determining NS are possible as well.

At block 668, machine 100 can add NS to NSPINS[W1], which is a number of hot mode spins for wager W1. For example, if NSPINS[W1] was previously 0, NSPINS[W1]= NS; otherwise, NSPINS[W1] will be increased by NS.

At block 670, machine 100 can determine whether a gaming session is to end. For example, machine 100 can have a "CASH OUT" or "END SESSION" physical and/or graphical button, and if one of these buttons is selected, the gaming session can end. As another example, the gaming session can end if the player has exhausted their credit balance (i.e., a player's credit balance is 0). If the gaming session is to continue (i.e., not end), then machine 100 can proceed to block 680; otherwise, if the gaming session is to end, and machine 100 can proceed to block 684.

At block 680, machine 100 can proceed to block 614 (shown in FIG. 6A and discussed above) to conduct another spin.

At block 684, machine 100 can provide a payout to the player based on the player's credit balance, if the credit balance is not exhausted. For example, if the player's credit balance is 28 credits and each credit is worth 2 cents, then the payout for this example would be 56 cents. The payout can be provided using payment interface 120 of machine 100. After providing the payout, machine 100 can end the gaming session, and consequently set 600 can be completed.

Notably, the operations of replacing, reordering, adding, and/or removing symbols from a reel of a reel-based game (e.g., the operations of blocks 618-680 as just some possible examples), necessitate computer implementation. In a mechanical reel-based game, the symbols appearing on each reel are fixed and cannot be changed mid-game. In contrast, the computer implementation herein allows the number of symbols per reel to be changed, as well as the symbols appearing on each reel to be replaced and/or re-ordered and/or to be changed during a game based on cross-dependency with the symbols of other reels. These changes can occur mid-game, for example between spins of the reels or at the end of a game, for example after a spin and based on the symbols identified for the different reels. Consequently, these features of the disclosure herein would not exist but for computer technology.

Particularly, the embodiments herein solve a technical problem of how to add movement to individual symbols of a reel-based game and further unpredictability in the reel-based game. The operations of replacing, reordering, adding, and/or removing symbols from a reel would be prohibitively complex and expensive to implement on a traditional machine with mechanical reels. In effect, the present approach can be seen as providing an implementation which increases the number and variety of possible outcomes in a random selection of data entries based on a reel-based game of luck.

For example, embodiments that involve selecting a set of symbols that includes an instance of the predetermined locking symbol when the instance of the predetermined locking symbol was locked in place from a previous iteration of the bonus game and has been used in fewer than n winning combinations of symbols in the bonus game, or when the instance of the predetermined locking symbol was initially selected during the respective iteration of the bonus game clearly involve a computerized implementation. In particular, computerized implementation is necessitated because when an instance of the predetermined locking symbol, located on a particular reel, is locked down in a fixed position of the symbol-display-portion, the remaining symbols on the particular reel continue to spin. In a traditional machine with mechanical reels, locking down a single symbol on a given reel would result in the remaining symbols on the given reel also being locked down. Thus, to allow individual symbol locking, a computerized implementation is necessary to allow for replacing, reordering, adding, and/or removing of individual symbols on each of the reels.

Further, these features are an improvement to reel-based gaming technology. Since the symbols appearing on each reel are fixed and cannot be changed mid-game in mechanical reel-based games, the operations of replacing, reordering, adding, and/or removing symbols from a reel could not appear in such games. Due to this technological limitation, players may become disinterested in these basic reel-based games. Computer implementation, however, facilitates the integration of these features into reel-based games, resulting in game dynamics that would otherwise be unavailable. Consequently, the disclosure herein is a technological improvement to reel-based games.

Example Gaming Machine Scenario

FIGS. 7-14 depict displays of scenario 700, in accordance with example embodiments. In scenario 700, a gaming machine, such as machine 100, server machine 100*a* and/or client machine 100*b*, can be used to conduct a gaming session in accordance with the set 600 of operations discussed above in the context of FIGS. 6A and 6B. Displays of the gaming machine shown with regard to scenario 700 can be based on screenshot 400 discussed above at least in the context of FIG. 4.

Figure 7:
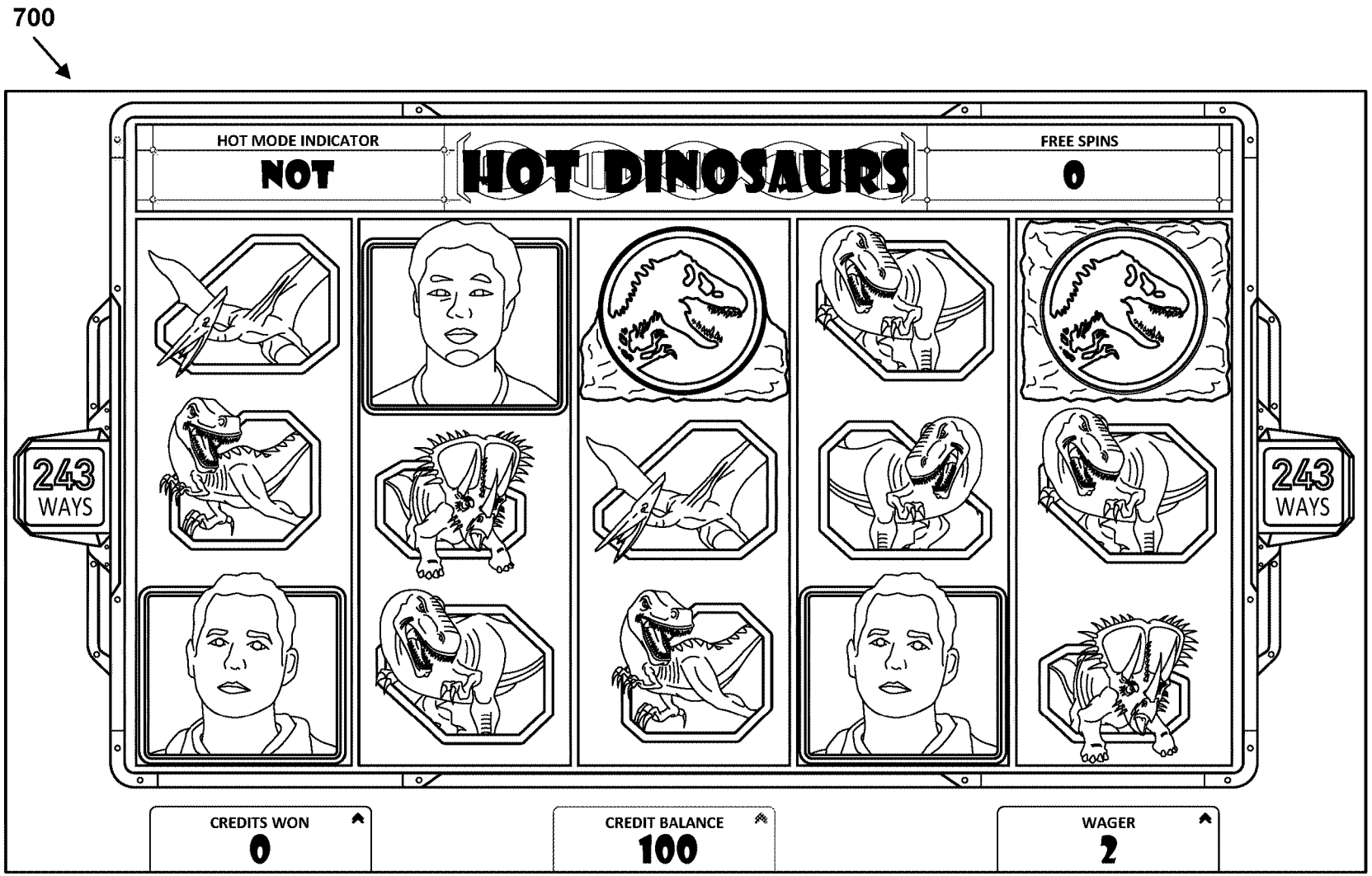
FIG. 7 shows a first display of a gaming session scenario, in accordance with example embodiments.
Figure 10:
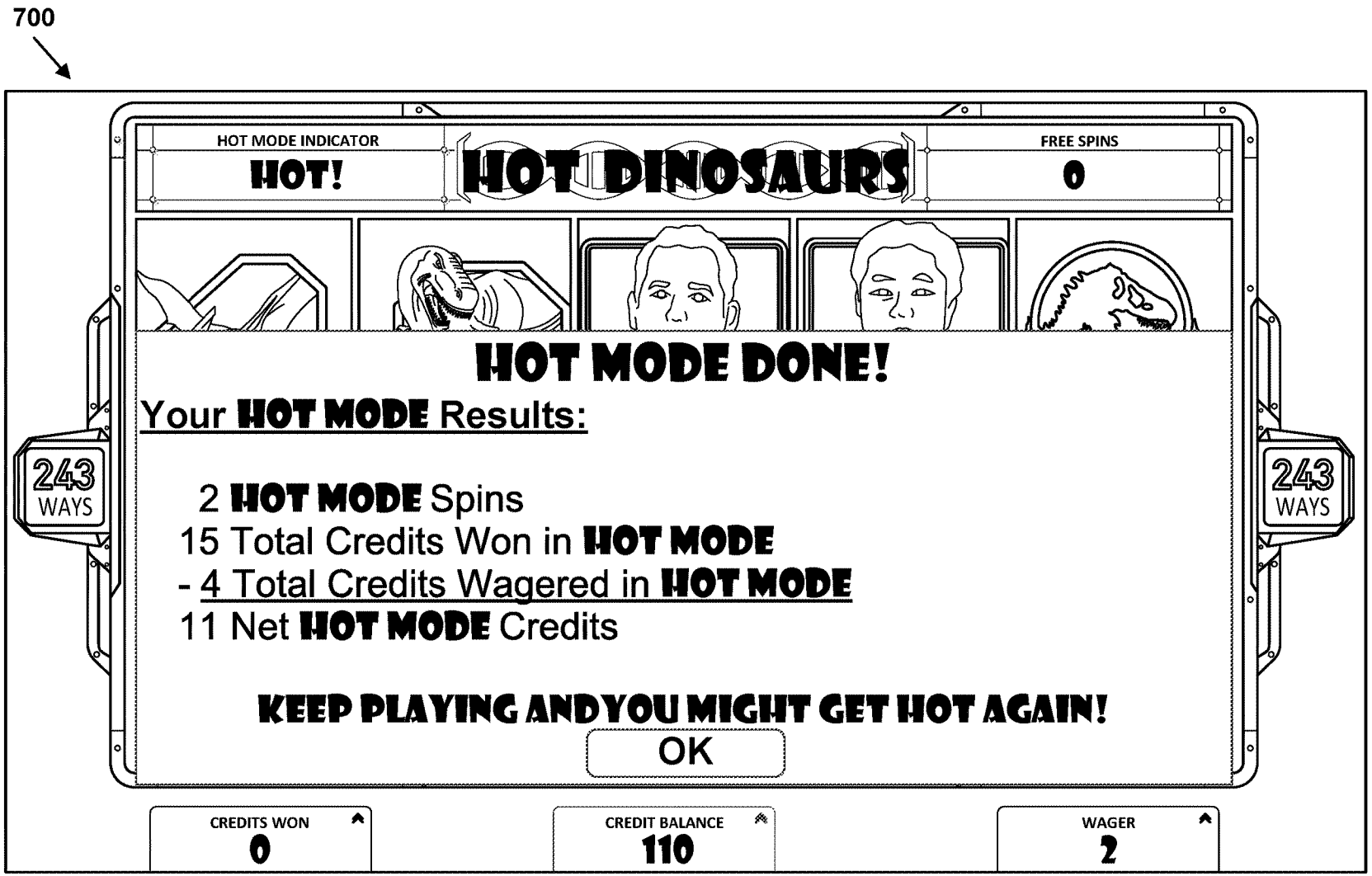
FIG. 10 shows a fourth display of a gaming session scenario, in accordance with example embodiments.

As shown in FIG. 7, at the onset of scenario 700 the gaming session includes placing a wager of two credits at a gaming machine, such as machine 100, in a normal state. As a result of the spin, the gaming machine activates a hot mode state illustrated in FIG. 8. In scenario 700, while in the hot mode state. the gaming machine provides an actual rate of return to the player that exceeds 100% and each wager in the hot mode state has to be the same size as the wager made at the time the gaming machine activated the hot mode state; that is, each wager in this particular hot mode state has to be a two credit wager. FIGS. 9A, 9B, and 10 indicate that two spins are conducted in this hot mode state—during those two spins, four credits are wagered, and the player wins 15 total credits.

Figure 11:
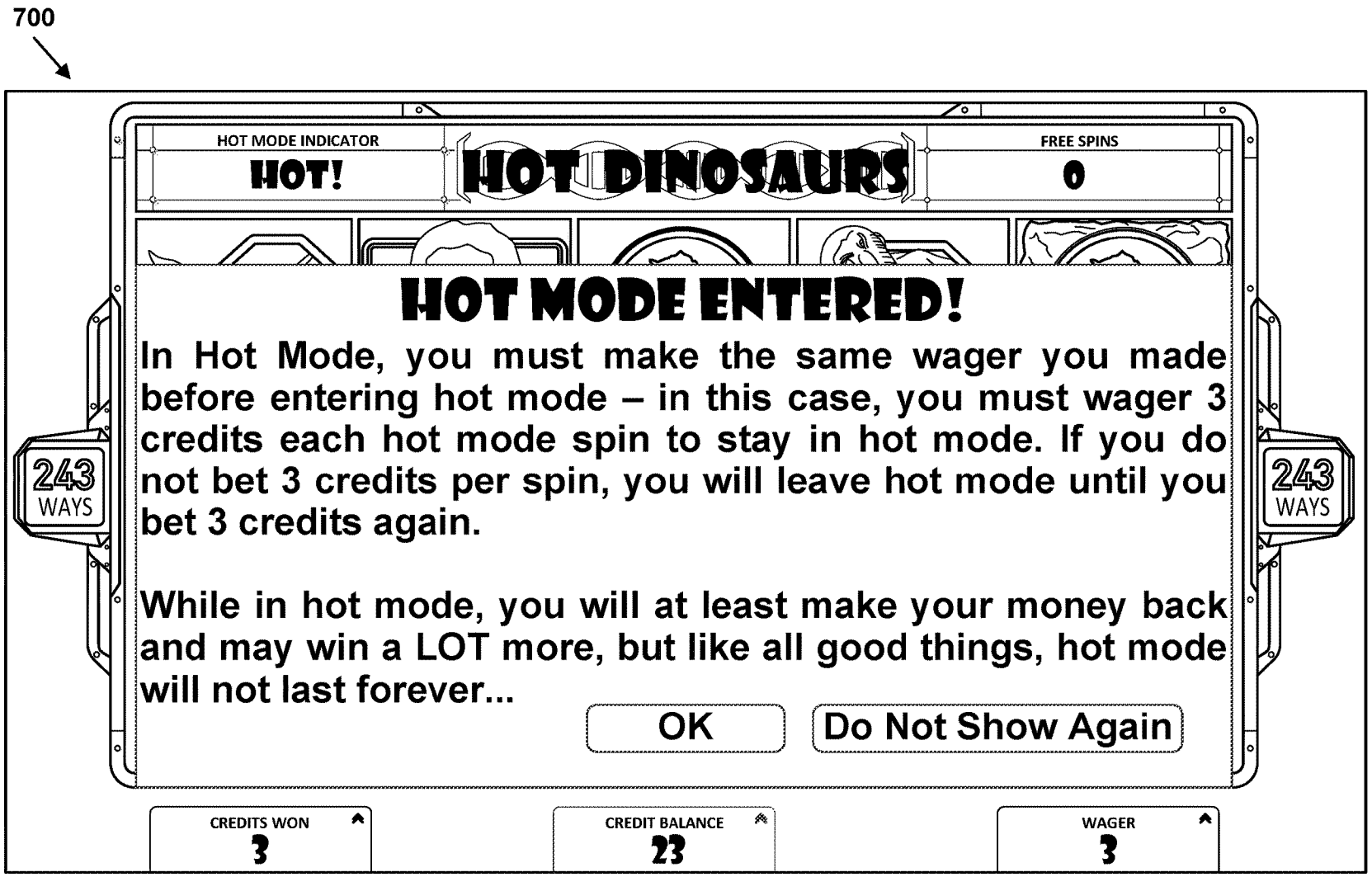
FIG. 11 shows a fifth display of a gaming session scenario, in accordance with example embodiments.
Figure 12:
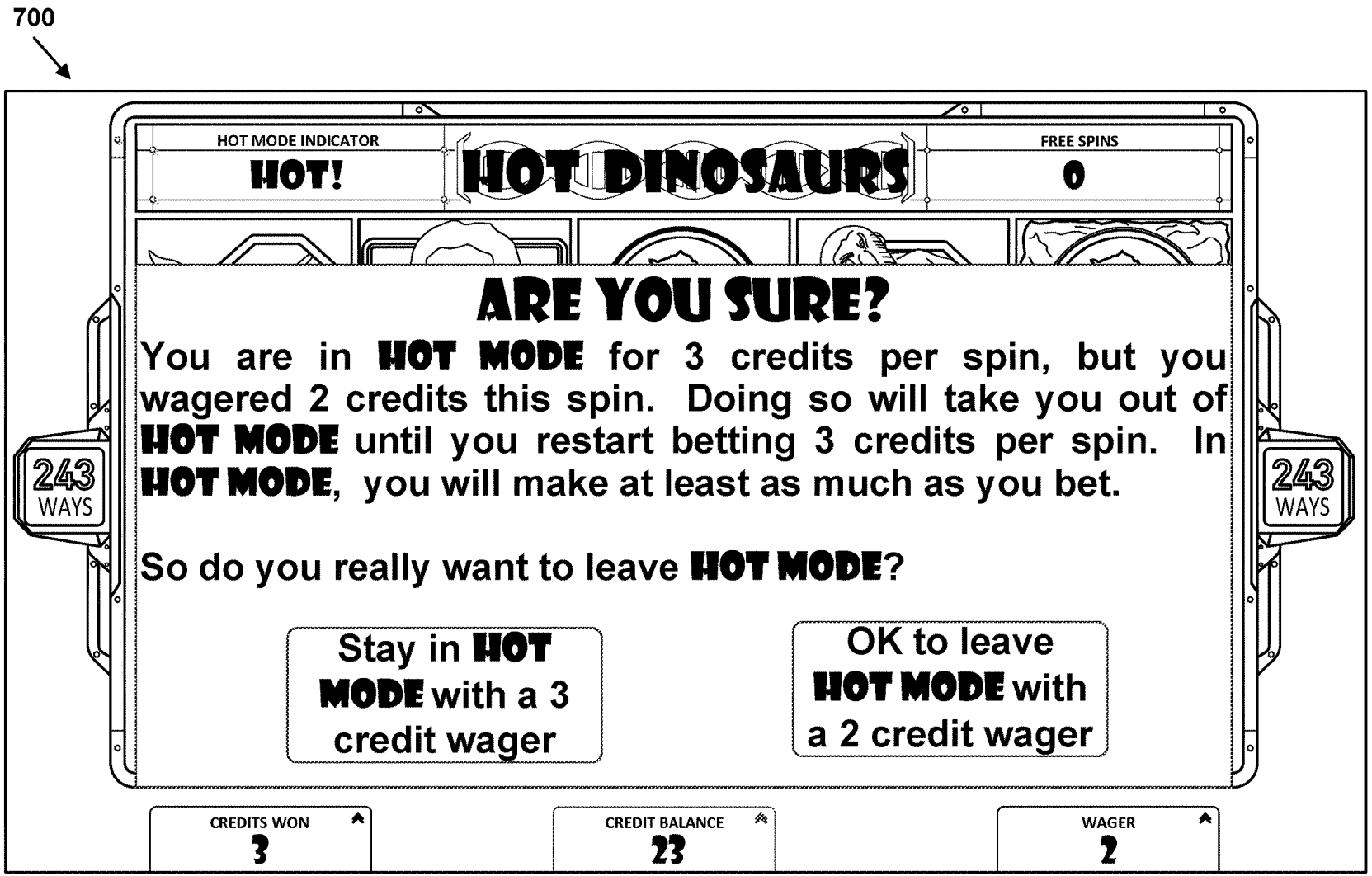
FIG. 12 shows a sixth display of a gaming session scenario, in accordance with example embodiments.

After the two hot mode spins, the gaming machine re-enters the normal state. While in the normal state, a wager of three credits is placed at the gaming machine and hot mode state of the gaming machine is reactivated as shown in FIG. 11. After the hot mode state is reactivated, a two credit wager is made as can be seen in FIG. 12, which causes the gaming machine to leave the hot mode state before all hot mode spins associated with three credit wagers are completed. After one spin with the two credit wager shown in FIG. 13, a three credit wager is received at the gaming machine, and FIG. 14 illustrates that the hot mode state for three credit wagers is reactivated. After the hot mode state is reactivated, scenario 700 can be completed.

FIG. 7 shows a display of a "HOT DINOSAURS" gaming machine; that is, the gaming machine of scenario 700, generated at an onset of scenario 700. At upper left of the display, the gaming machine is in a normal state and has a "hot mode indicator" displaying "NOT" to indicate the gaming machine is not in a hot mode state at this point in the gaming session. At upper right of the display, the gaming machine has a "free spins" indicator indicating that zero free spins are available. Other indicators of the display reveal that the last wager of two credits (shown at lower right) lead to zero credits won (shown at lower left). At lower centre of the display, a credit balance indicator shows that a player of the gaming machine has 100 available for wagering. The gaming session of scenario 700 continues until the gaming machine accepts a two credit wager, leaves the normal state, and activates the hot mode state.

Figure 8:
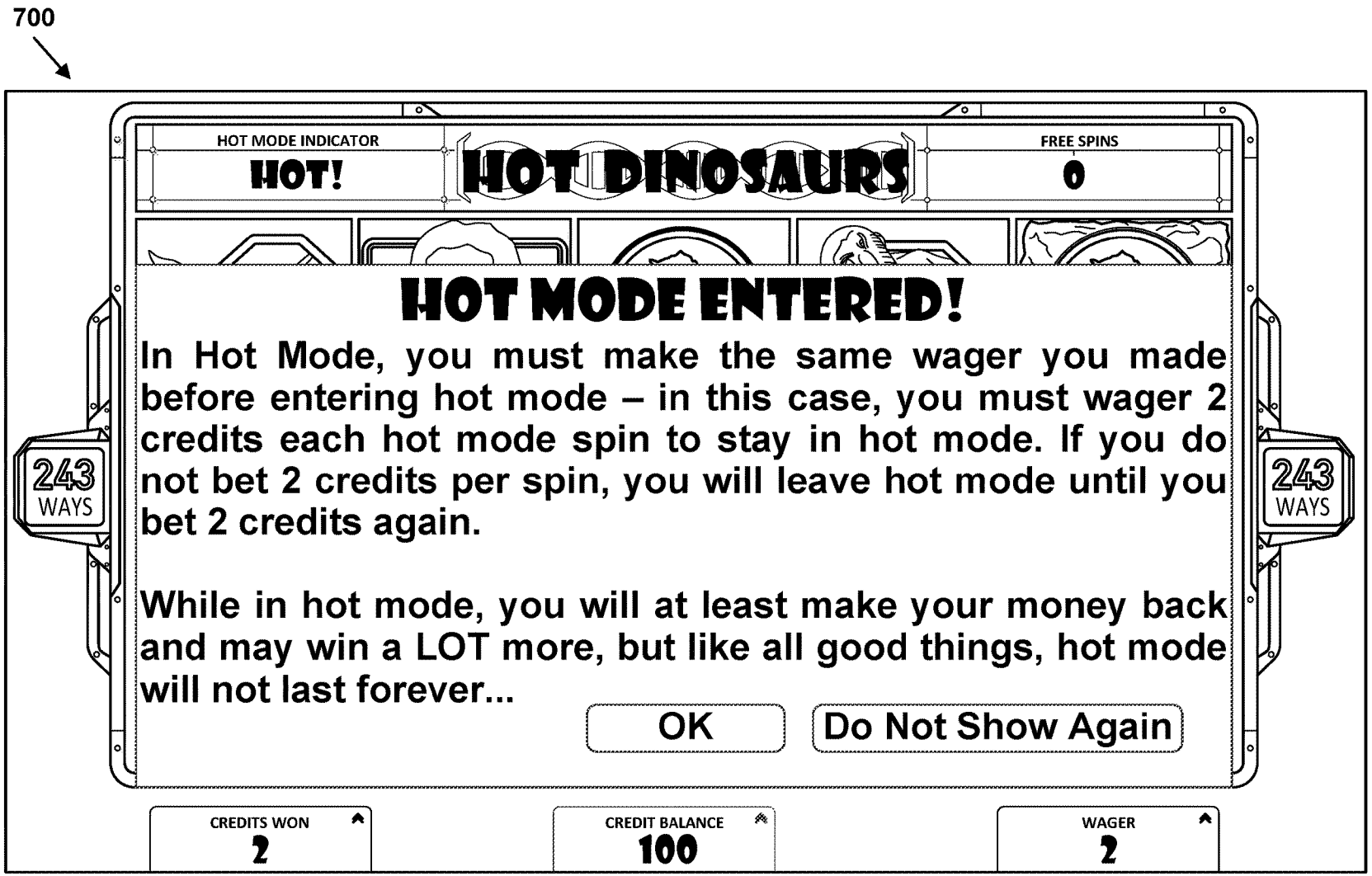
FIG. 8 shows a second display of a gaming session scenario, in accordance with example embodiments.

FIG. 8 shows a display informing the player that the gaming machine is now in the hot mode state. To that end, the display shows that the hot mode indicator is "HOT" and includes a hot-mode-entry dialog indicating that "HOT MODE" was "ENTERED!" The hot-mode-entry dialog also explains that the player has to make constant-sized wagers whose sizes are the same as a wager size made prior to entering the hot mode state. Specifically, the hot-mode-entry dialog informs the player that "you must make the same wager you made before entering hot mode—in this case, you must wager 2 credits per hot mode spin to stay in hot mode. If you do not bet 2 credits per spin, you will leave hot mode until you bet 2 credits again". The hot-mode-entry dialog also informs the player that the hot mode state is a temporary state with a RoR of at least 100% by stating "[w]hile in hot mode, you will make at least your money back and may win a LOT more, but like all good things, hot mode will not last forever . . . "

The hot-mode-entry dialog also includes an "OK" button that, when selected, instructs the gaming machine to stop displaying the hot-mode-entry dialog and a "Do Not Show Again" button that, when selected, instructs the gaming machine to stop displaying the hot-mode-entry dialog and not to display the hot-mode-entry dialog during a remainder of the gaming session. In other scenarios, the gaming machine may not display a hot-mode-entry dialog and/or may display a different dialog than the hot-mode-entry dialog when the hot mode state is entered. In still other scenarios, the gaming machine may not utilize a hot mode indicator to show that the hot mode state when the hot mode state is entered and/or may utilize a different hot mode indicator than shown in FIG. 8

While in the hot mode state, the gaming machine can generate displays of symbols selected from the same symbol table and/or symbol group used in a non-hot-mode state and/or can display symbols selected from a symbol table and/or symbol group utilized only during the hot mode state, as discussed above in more detail in the context of at least FIG. 3.

For an example of displaying symbols also used in the non-hot-mode state, FIG. 9A shows the gaming machine in a hot mode state and displaying symbols selected from the same symbol table and/or symbol group used to generate displays when the gaming machine was not in a hot mode state. That is, the displays of FIG. 7 (when the gaming machine was not in a hot mode state) and FIG. 9A (when the gaming machine was in a hot mode state) both show symbols depicting humans and dinosaurs. The display of FIG. 9A shows a winning combination of dinosaur symbols arrayed in a middle row of the display; e.g., the middle row of symbol-display-portion 402. The display of FIG. 9A indicates that the winning combination shown in the symbol-display-portion returned 15 credits of winnings on a two credit wager made while in the hot mode state.

In contrast with FIG. 9A, the display of FIG. 9B uses at least some symbols selected from a different symbol table and/or symbol group used to generate displays when the gaming machine was not in the hot mode state, such as the display shown in FIG. 7; i.e., FIG. 9B shows an example hot-mode specific symbol set in the context of scenario 700. In particular, the symbols selected from the different symbol table and/or symbol group include at least five different symbols for wins during a hot mode state of one, two, three, four, and five credits, and perhaps a symbol for a blank image. For example, a middle row of the symbol-display-portion of FIG. 9B shows five images that, from left to right, are: a blank image, a blank image, an image of a "HOT WIN" for "2 CREDITS!", an image of a "HOT WIN" for "1 CREDIT!", and a blank image. The display of FIG. 9B indicates that the winning combination shown in the symbol-display-portion returned 15 credits of winnings on a two credit wager while in the hot mode state.

In hot mode states of scenario 700, the gaming machine selects from the same symbol table and/or symbol group used to generate displays when the gaming machine was not in a hot mode state, such the symbols as shown in FIG. 9A. In other scenarios, the gaming machine can, while in a hot mode state, select symbols from a different symbol table and/or symbol group used to generate displays when the gaming machine was not in the hot mode state, such as the symbols shown in FIG. 9B. Scenario 700 continues with two hot mode spins in the hot mode state before the gaming machine deactivates the hot mode state and re-enters the normal state.

FIG. 10 shows a display of the gaming machine upon deactivating the hot mode state. The display includes a hot-mode-summary dialog for a summary of "HOT MODE Results" indicating that, during the hot mode state "2 HOT MODE Spins" were made, leading to "15 Total Credits Won in HOT MODE", "−4 Total Credits Wagered in HOT MODE", and "11 Net HOT MODE Credits". The hot-mode-summary dialog also includes an encouragement to keep playing.

The display shown in FIG. 10 further shows a result of "0" credits won during the last (second) hot mode spin. Even though the last hot mode spin lead to a player loss of two credits, the player RoR during the hot mode is above 100%. More particularly, using Equation (1) operating on the information provided by the summary in the hot-mode-summary dialog of FIG. 10, the player's RoR during the two hot mode spins is: RoR=15/4=3.75 or, expressed as a percentage, 375%, which is well above 100%. Thus, even though one (or more generally, some) hot mode spins do not produce winning results for a player, the hot-mode-summary dialog data shows that player RoR during the hot mode can remain above 100%, as stated in the hot-mode-entry dialog shown in FIG. 8.

Scenario 700 continues with the player continuing the gaming session in the normal state until the gaming machine re-activates into the hot mode state after a 3-credit wager. FIG. 11 shows a display generated by the gaming machine upon re-activation of the hot mode state. The display shown in FIG. 11 is similar to the display discussed above in more detail and shown in FIG. 8. However, the hot-mode-entry dialog shown in FIG. 11 differs from the hot-mode-entry dialog shown in the context of FIG. 8, in that the hot-mode-entry dialog shown in FIG. 11 informs the player that three credit wagers are wagers whose sizes are the same as a wager size made prior to entering the hot mode state, rather than the two credit wagers mentioned in the hot-mode-entry dialog of FIG. 8. In other scenarios, the gaming machine may not display a hot-mode-entry dialog and/or may display a different dialog than the hot-mode-entry dialog when the hot mode state is entered than shown in FIG. 11.

The gaming session of scenario 700 continues with the player making a wager of two credits just after the hot mode state had been entered. The new two credit wager differs from the three credit wager size made prior to re-activation of the hot mode state. Since the current two credit wager differs from the previous three credit wager, the gaming machine can temporarily deactivate the hot mode state; i.e., put the gaming machine into a normal state, until wagers of three credits are resumed.

FIG. 12 shows a display generated by the gaming machine upon receiving the two credit wager after the hot mode state was reactivated with a three credit wager. The display shown in FIG. 12 includes a hot-mode-decision dialog that asks "ARE YOU SURE?" and informs the player that making a two credit wager will cause exit from the hot mode state. In particular, the hot-mode-decision dialog states that "[y]ou are in hot mode for 3 credits per spin, but you wagered 2 credits this spin. Doing so will take you out of hot mode until you restart betting 3 credits per spin. In hot mode, you will make at least as much as you bet. So do you really want to leave hot mode?"

The hot-mode-decision dialog also includes two buttons—a stay-in-hot-mode button and a leave-hot-mode button—that can be used by the player to indicate their choice of either staying in the hot mode state or exiting the hot mode state. The stay-in-hot-mode button states that, if selected, the gaming machine will "[s]tay in HOT HODE" by making a "3 credit wager". The leave-hot-mode button states that, if selected, the gaming machine will "leave HOT HODE" by making a "2 credit wager". In other scenarios, the gaming machine may not display a dialog and/or may display a different dialog when the hot mode state may be temporarily deactivated than shown in FIG. 12.

Scenario 700 continues with the gaming session proceeding by the player selecting the leave-hot-mode button of the hot-mode-decision dialog shown in FIG. 12, leaving the hot mode state for the normal state, and thereby making a two credit wager. As the hot mode state was left prior to completing all hot mode spins associated with three credit wagers; the hot mode state associated with three credit wagers can be reactivated if the player resumes making three credit wagers.

Figure 13:
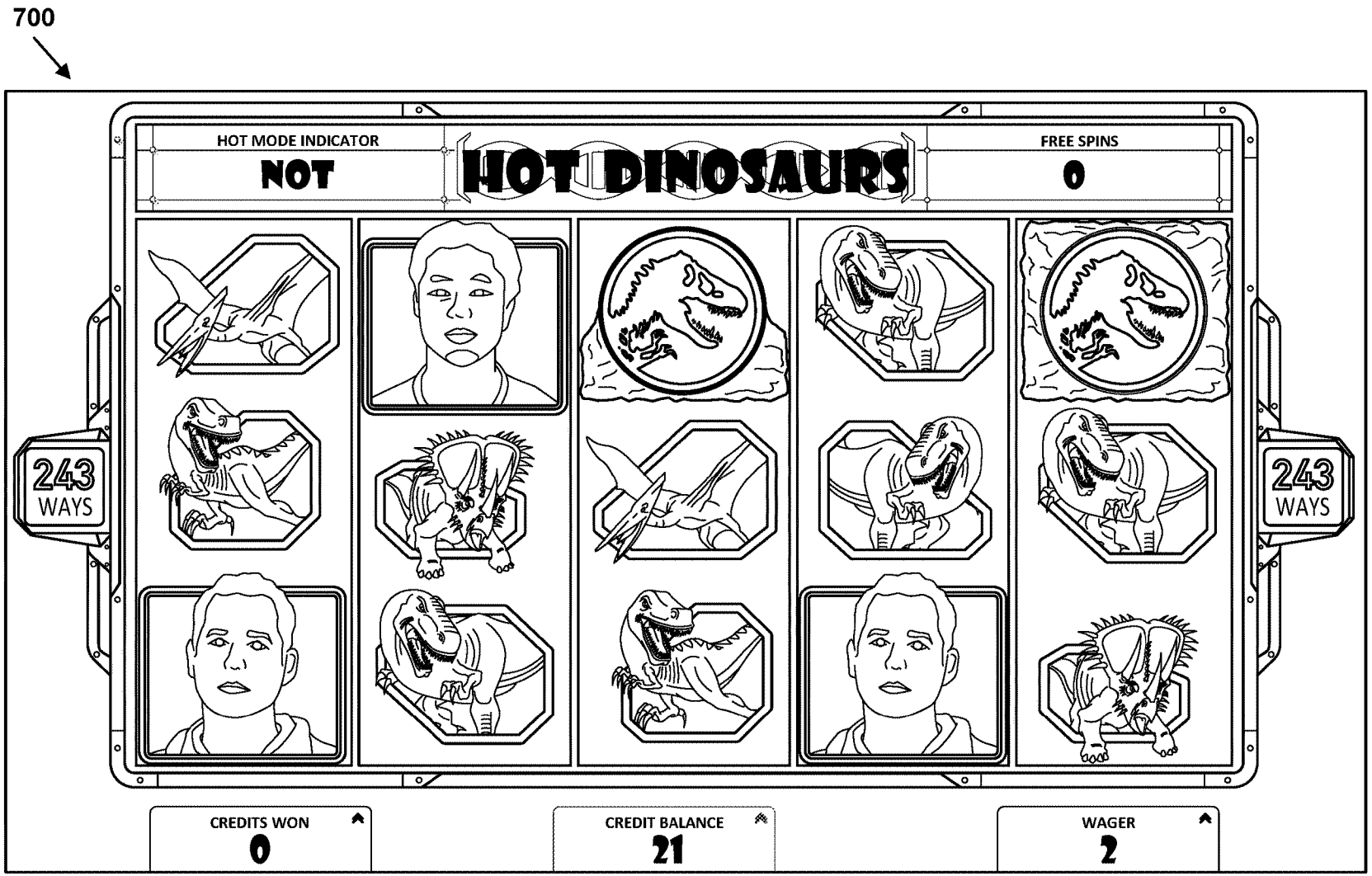
FIG. 13 shows a seventh display of a gaming session scenario, in accordance with example embodiments.
Figure 14:
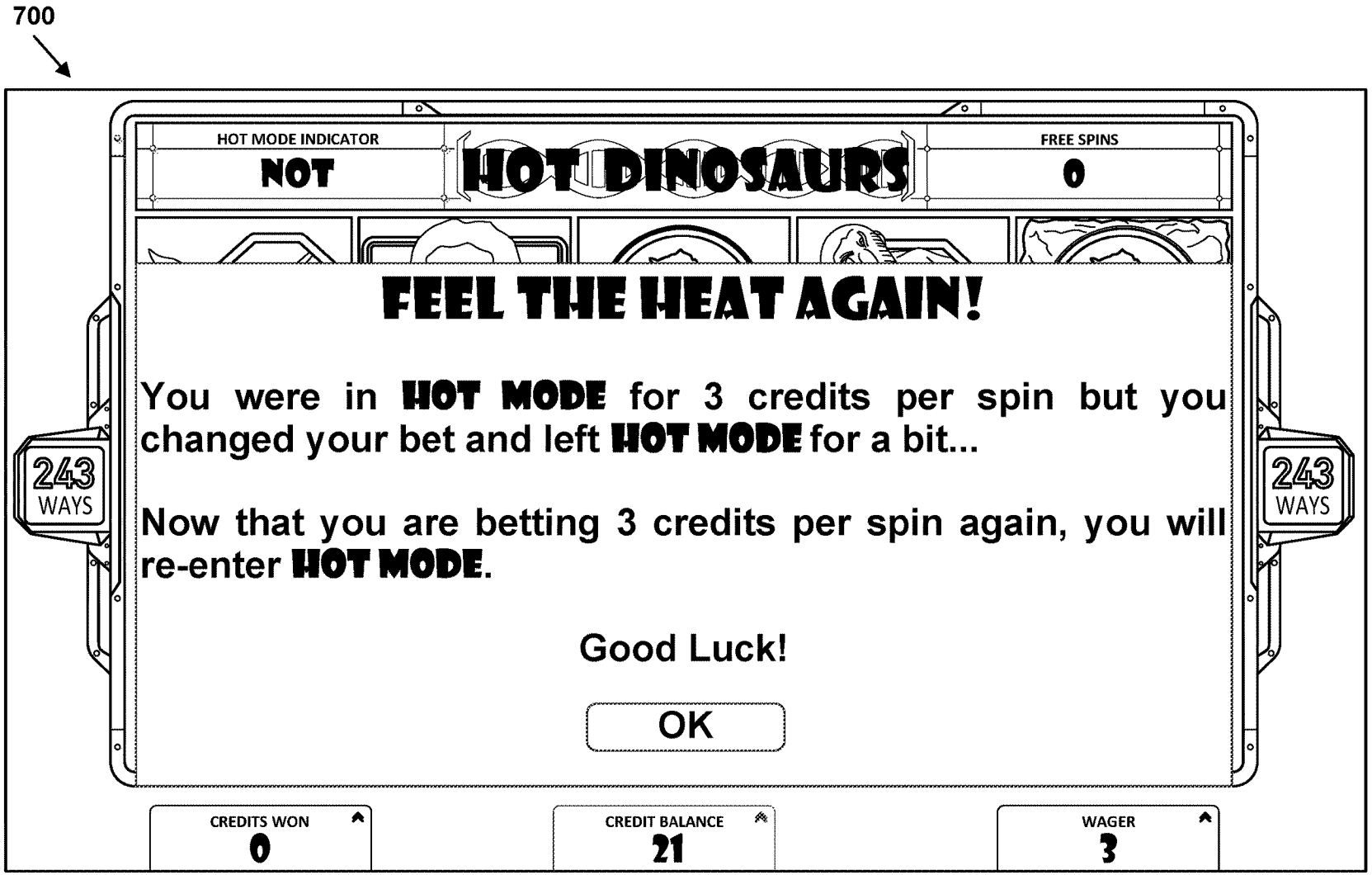
FIG. 14 shows an eighth display of a gaming session scenario, in accordance with example embodiments.

FIG. 13 shows a display generated shortly after a spin for the two credit wager in the normal state mentioned in the prior paragraph is completed. The display shows that "0" credits were won during the spin and that the player has a credit balance of "21" credits. After one spin with a two credit wager, scenario 700 continues with the gaming machine receiving a three credit wager and consequently reactivating the hot mode state associated with three credit wagers.

FIG. 14 shows a display generated shortly the hot mode state was reactivated. The display shows a hot-mode-reactivation dialog that informs the player that the hot mode state is about to be reactivated. In particular, the hot-mode-reactivation dialog states that the player was "in HOT MODE for 3 credits per spin but you changed your bet and left HOT MODE for a bit" and "[n]ow that you are betting 3 credits per spin again, you will re-enter HOT MODE". By selecting the "OK" button of hot-mode-reactivation dialog, the player can make a three credit wager and the gaming machine can subsequently reactivate the hot mode state. Once the gaming machine has reactivated the hot mode state for three credit wagers, scenario 700 can be completed. Some related scenarios can end when at least one of the hot mode spins has been completed.

In other scenarios, multiple hot mode states can be possible at one time. For example, suppose that after making the two credit wager associated with FIGS. 12 and 13, the gaming machine determined to enter the hot mode state for the two credit wager. At that time, the gaming machine could be in one of two hot mode states—one hot mode state after receiving a wager of two credits or a one hot mode state after receiving a wager of three credits. Further, at that time the player may still be able to make a different sized wager than two or three credits. Then, both of the hot mode states can be deactivated until either a wager of two or three credits is received or the hot mode state is activated for a (third) different wager amount. In these other scenarios, a maximum number of possible hot mode states equals a number of possible wager sizes.

Example Operations

Figure 15:
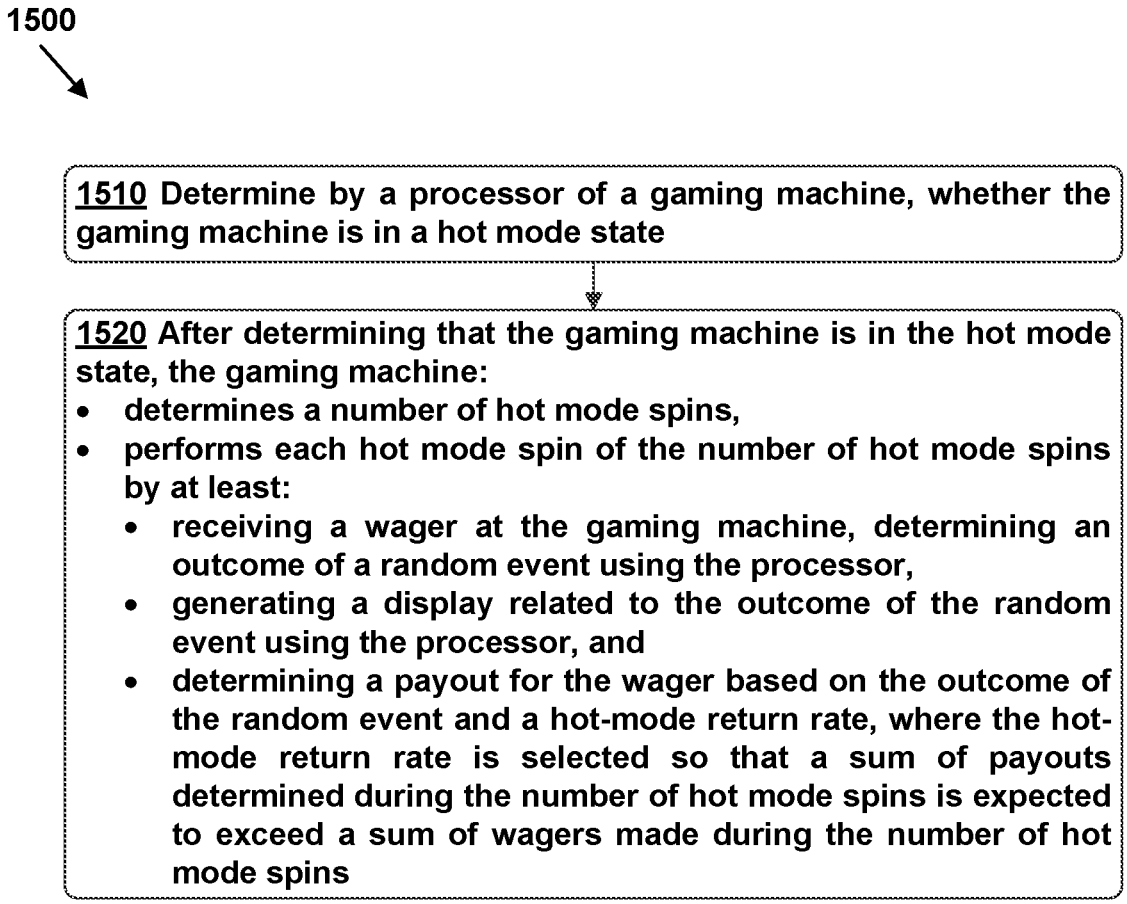
FIG. 15 is a flow chart of a method utilizing a gaming machine, in accordance with example embodiments.

FIG. 15 depicts a flow chart showing a set of operations 1500 (or more simply, "the set 1500") that can be carried out using a gaming machine, such as but not limited to machine 100. In some embodiments, the gaming machine is configured to be a standalone gaming machine, such as discussed above in the context of FIG. 1.

At block 1510, a processor of the gaming machine, such as processor 114, can determine whether the gaming machine is in a hot mode state, such as discussed above in the context of at least FIGS. 6A-14.

At block 1520, after determining that the gaming machine is in the hot mode state, the gaming machine can determine a number of hot mode spins and perform each hot mode spin of the number of hot mode spins. The gaming machine can perform each hot mode spin by at least: receiving a wager at the gaming machine, determining an outcome of a random event using the processor, generating a display related to the outcome of the random event using the processor, and determining a payout for the wager based on the outcome of the random event and a hot-mode return rate, where the hot-mode return rate is selected so that a sum of payouts determined during the number of hot mode spins is expected to exceed a sum of wagers made during the number of hot mode spins, such as discussed above in the context of at least FIGS. 6A-14.

In some embodiments, the hot-mode return rate is selected so that an actual sum of payouts determined during the number of hot mode spins does exceed a sum of wagers made during the number of hot mode spins, such as discussed above in the context of at least FIGS. 6A-14.

In some embodiments, receiving the wager at the gaming machine can include receiving a wager of a first wager amount at the gaming machine, and where each wager during the number of hot mode spins is a wager of the first wager amount, such as discussed above in the context of at least FIGS. 6A-14.

In some embodiments, receiving the wager at the gaming machine can include receiving a first wager of a first wager amount at the gaming machine for a first hot mode spin of the number of hot mode spins, and where performing each hot mode spin of the number of hot mode spins can further include: after the first hot mode spin has completed, receiving a second wager of a second wager amount at the gaming machine for a second hot mode spin of the number of hot mode spins; determining whether the second wager amount differs from the first wager amount using the processor; and after determining that the second wager amount differs from the first wager amount, the gaming machine at least: determining not to carry out the second hot mode spin; and putting the gaming machine into a normal state, such as discussed above in the context of at least FIGS. 11-14. In particular, determining not to carry out the second hot mode spin can include generating a display indicating that the gaming machine is not in the hot mode state, such as discussed above in the context of at least FIGS. 12 and 13. Additionally, set 1500 can further include: after putting the gaming machine into the normal state, receiving a third wager at the gaming machine; determining whether the third wager is of the first wager amount using the processor; after determining that the third wager is of the first wager amount, the gaming machine at least: putting the gaming machine into the hot mode state; and carrying out the second hot mode spin using the third wager, as discussed above in the context of at least FIGS. 13 and 14.

In some embodiments, set 1500 can further include: after the gaming machine has completed each hot mode spin of the number of hot mode spins, putting the gaming machine into a normal state; and performing one or more spins using the gaming machine in the normal state by at least: receiving a wager at the gaming machine, determining an outcome of a random event using the processor, generating a display related to the outcome of the random event using the processor, and determining a payout for the wager based on the outcome of the random event and a normal-state return rate, where the normal-state return rate is less than the hot-mode return rate, such as discussed above in the context of at least FIGS. 6A and 14. In particular, the normal-state return rate can be less than 100%, and where the hot-mode return rate can be greater than 100%, such as discussed above in the context of at least FIG. 6A.

In some embodiments, performing one or more spins using the gaming machine in the normal state can further include: determining whether the outcome of the random event is a hot-mode-entry event; and after determining that the outcome of the random event is a hot-mode-entry event, putting the gaming machine into the hot mode state, such as discussed above in the context of at least FIG. 6B. In particular, performing one or more spins using the gaming machine in the normal state can further include: determining an actual return rate for one or more spins while in the normal state; determining whether the actual return rate is less than a low-hot-mode-entry threshold; and after determining that the actual return rate is less than the low-hot-mode-entry threshold, putting the gaming machine into the hot mode state, such as discussed above in the context of at least FIG. 6B. Also in particular, performing one or more spins using the gaming machine in the normal state can further include: determining an actual return rate for one or more spins while in the normal state; determining whether the actual return rate is greater than a high-hot-mode-entry threshold; and after determining that the actual return rate is greater than the high-hot-mode-entry threshold, putting the gaming machine into the hot mode state, such as discussed above in the context of at least FIG. 6B.

In some embodiments, the set 1500 can further include: after determining that the gaming machine is in the hot mode state, the gaming machine generating a display indicating that the gaming machine is in the hot mode state, such as discussed above in the context of at least FIGS. 4 and 6A-14. In particular, generating a display indicating that the gaming machine is in the hot mode state can include generating a display indicating that the gaming machine is in the hot mode state without disclosing the number of hot mode spins, such as discussed above in the context of at least FIG. 4.

Additional Example Embodiments

The following clauses are offered as further description of the disclosed embodiments.

Clause 1—A computer-implemented method including: determining, by a processor of a gaming machine, whether the gaming machine is in a hot mode state; and after determining that the gaming machine is in the hot mode state, the gaming machine: determining a number of hot mode spins; performing each hot mode spin of the number of hot mode spins by at least: receiving a wager at the gaming machine, determining an outcome of a random event using the processor, generating a display related to the outcome of the random event using the processor, and determining a payout for the wager based on the outcome of the random event and a hot-mode return rate, where the hot-mode return rate is selected so that a sum of payouts determined during the number of hot mode spins is expected to exceed a sum of wagers made during the number of hot mode spins.

Clause 2—The computer-implemented method of clause 1, wherein the hot-mode return rate is selected so that an actual sum of payouts determined during the number of hot mode spins does exceed a sum of wagers made during the number of hot mode spins Clause 3—The computer-implemented method of either clause 1 or clause 2, further including: after the gaming machine has completed each hot mode spin of the number of hot mode spins, putting the gaming machine into a normal state; and performing one or more spins using the gaming machine in the normal state by at least: receiving a wager at the gaming machine, determining an outcome of a random event using the processor, generating a display related to the outcome of the random event using the processor, and determining a payout for the wager based on the outcome of the random event and a normal-state return rate, where the normal-state return rate is less than the hot-mode return rate.

Clause 4—The computer-implemented method of clause 3, where the normal-state return rate is less than 100%, and where the hot-mode return rate is greater than 100%

Clause 5—The computer-implemented method of either clause 3 or clause 4, where performing one or more spins using the gaming machine in the normal state further includes: determining whether the outcome of the random event is a hot-mode-entry event; and after determining that the outcome of the random event is a hot-mode-entry event, putting the gaming machine into the hot mode state.

Clause 6—The computer-implemented method of any one of clauses 3-5, where performing one or more spins using the gaming machine in the normal state further includes: determining an actual return rate for one or more spins while in the normal state; determining whether the actual return rate is less than a low-hot-mode-entry threshold; and after determining that the actual return rate is less than the low-hot-mode-entry threshold, putting the gaming machine into the hot mode state.

Clause 7—The computer-implemented method of any one of clauses 3-6, where performing one or more spins using the gaming machine in the normal state further includes: determining an actual return rate for one or more spins while in the normal state; determining whether the actual return rate is greater than a high-hot-mode-entry threshold; and after determining that the actual return rate is greater than the high-hot-mode-entry threshold, putting the gaming machine into the hot mode state.

Clause 8—The computer-implemented method of any one of clauses 1-7, further including: after determining that the gaming machine is in the hot mode state, the gaming machine generating a display indicating that the gaming machine is in the hot mode state.

Clause 9—The computer-implemented method of clause 8, where generating a display indicating that the gaming machine is in the hot mode state includes generating a display indicating that the gaming machine is in the hot mode state without disclosing the number of hot mode spins.

Clause 10—The computer-implemented method of any one of clauses 1-9, where receiving the wager at the gaming machine includes receiving a wager of a first wager amount at the gaming machine, and where each wager during the number of hot mode spins is a wager of the first wager amount.

Clause 11—The computer-implemented method of any one of clauses 1-10, where receiving the wager at the gaming machine includes receiving a first wager of a first wager amount at the gaming machine for a first hot mode spin of the number of hot mode spins, and where performing each hot mode spin of the number of hot mode spins further includes: after the first hot mode spin has completed, receiving a second wager of a second wager amount at the gaming machine for a second hot mode spin of the number of hot mode spins; determining whether the second wager amount differs from the first wager amount using the processor; and after determining that the second wager amount differs from the first wager amount, the gaming machine at least: determining not to carry out the second hot mode spin; and putting the gaming machine into a normal state.

Clause 12—The computer-implemented method of clause 11, where determining not to carry out the second hot mode spin includes generating a display indicating that the gaming machine is not in the hot mode state.

Clause 13—The computer-implemented method of clause 11 or clause 12, further including: after putting the gaming machine into the normal state, receiving a third wager at the gaming machine; determining whether the third wager is of the first wager amount using the processor; after determining that the third wager is of the first wager amount, the gaming machine at least: putting the gaming machine into the hot mode state; and carrying out the second hot mode spin using the third wager.

Clause 14—The computer-implemented method of any one of clauses 1-13, where the gaming machine is configured to be a standalone gaming machine.

Clause 15—An article of manufacture including a computer-readable medium, having stored thereon instructions that, upon execution by a processor of a gaming machine, cause the gaming machine to perform operations of any one of clauses 0-14.

Clause 16—The article of manufacture of clause 15, where the computer-readable medium includes a non-transitory computer-readable medium.

Clause 17—A gaming machine including: a processor; memory; and program instructions, stored in the memory, that upon execution by the processor cause the gaming machine to perform the operations of any one of clauses 0-14.

Clause 18—The gaming machine of clause 17, where the memory includes a non-transitory computer-readable medium.

Clause 19—A gaming machine comprising means for performing the operations of any one of clauses 0-14.

Clause 20—A system, comprising the gaming machine of any one of clauses 17-19.

Conclusion

While one or more disclosed operations have been described as being performed by certain entities (e.g., machine 100, server machine 100*a*, or client machine 100*b*), one or more of the operations may be performed by any entity, including but not limited to those described herein. As such, while this disclosure includes examples in which the server machine 100*a* performs select operations and sends data to the client machine 100*b*, such that the client machine 100*b* may perform complementing operations and receive the data, variations may to those operations may be made while adhering to the general server-client dichotomy and the scope of the disclosed machines and methods.

For example, rather than the server machine 100*a* sending select data (e.g., a symbol set) to the client machine 100*b*, such that the client machine may generate and display appropriate images, the server machine 100*a* may itself generate the images and send them to the client machine 100*b* for display. Indeed, it will be appreciated by one of ordinary skill in the art that the "break point" between the server machine's operations and the client machine's operations may be varied.

Further, the described operations throughout this application need not be performed in the disclosed order, although in some examples, the recited order may be preferred. Also, not all operations need to be performed to achieve the desired advantages of disclosed machines and methods, and therefore not all operations are required.

Additionally, any enumeration of elements, blocks, or steps in this specification or the claims is for purposes of clarity. Thus, such enumeration should not be interpreted to require or imply that these elements, blocks, or steps adhere to a particular arrangement or are carried out in a particular order.

While examples have been described in terms of select embodiments, alterations and permutations of these embodiments will be apparent to those of ordinary skill in the art. Other changes, substitutions, and alterations are also possible without departing from the disclosed machines and methods in their broader aspects as set forth in the following claims.

What is claimed is:

1. A method performed by a gaming machine, the method comprising:

determining, by a processor of the gaming machine, that the gaming machine is in a hot mode state;

in response to determining that the gaming machine is in the hot mode state:

determining a number of hot mode spins;

performing each hot mode spin of the number of hot mode spins by:

receiving a first wager, determining an outcome of a first random event using the processor, generating a first display related to the outcome of the first random event, determining a first payout for the first wager based on the outcome of the first random event and a hot-mode return rate, wherein the hot-mode return rate is selected so that a first sum of payouts determined during the number of hot mode spins is expected to exceed a first sum of wagers made during the number of hot mode spins, and providing, by a payment interface coupled to the processor, a second payout based on the first payout if the outcome of the first random event is a win, determining that the gaming machine is in a normal mode state; and in response to determining that the gaming machine is in the normal mode state, for each of one or more normal mode spins:

receiving a second wager, determining a second outcome of a second random event, generating a second display related to the second outcome, determining a third payout for the second wager based on the outcome of the second random event and a normal mode return rate, wherein the normal mode return rate is selected so that a second sum of payouts determined during the one or more normal mode spins is expected to be less than a second sum of wagers made during the one or more normal mode spins, and providing, by the payment interface coupled to the processor, a fourth payout based on the third payout if the outcome of the second random event is a win.

2. The method of claim 1, wherein the hot-mode return rate is selected so that the first sum of payouts determined during the number of hot mode spins does exceed the first sum of wagers made during the number of hot mode spins.

3. The method of claim 1, wherein the normal mode return rate is less than 100%, and wherein the hot-mode return rate is greater than 100%.

4. The method of claim 1, further comprising:

determining that the second outcome is a hot-mode-entry event; and after determining that the second outcome is a hot-mode-entry event, putting the gaming machine into the hot mode state.

5. The method of claim 1, further comprising:

determining an actual return rate for one or more spins while in the normal mode state;

determining that the actual return rate is less than a low-hot-mode-entry threshold; and after determining that the actual return rate is less than the low-hot-mode-entry threshold, putting the gaming machine into the hot mode state.

6. The method of claim 1, further comprising:

determining an actual return rate for one or more spins while in the normal mode state;

determining that the actual return rate is greater than a high-hot-mode-entry threshold; and after determining that the actual return rate is greater than the high-hot-mode-entry threshold, putting the gaming machine into the hot mode state.

7. The method of claim 1, further comprising:

after determining that the gaming machine is in the hot mode state, the gaming machine generating a display indicating that the gaming machine is in the hot mode state.

8. The method of claim 7, wherein generating the display indicating that the gaming machine is in the hot mode state comprises generating a display indicating that the gaming machine is in the hot mode state without disclosing the number of hot mode spins.

9. The method of claim 1, wherein receiving the first wager at the gaming machine comprises receiving a wager of a first wager amount at the gaming machine, and wherein each wager during the number of hot mode spins is a wager of the first wager amount.

10. The method of claim 1, wherein receiving the first wager at the gaming machine comprises receiving a first wager of a first wager amount at the gaming machine for a first hot mode spin of the number of hot mode spins, and wherein performing each hot mode spin of the number of hot mode spins further comprises:

after the first hot mode spin has completed, receiving an additional wager of an additional wager amount at the gaming machine for a second hot mode spin of the number of hot mode spins;

determining whether the additional wager amount differs from the first wager amount using the processor; and after determining that the additional wager amount differs from the first wager amount, the gaming machine at least:

determining not to carry out the second hot mode spin; and putting the gaming machine into a normal state.

11. The method of claim 10, wherein determining not to carry out the second hot mode spin comprises generating a display indicating that the gaming machine is not in the hot mode state.

12. The method of claim 10, further comprising:

after putting the gaming machine into the normal state, receiving a third wager at the gaming machine;

determining whether the third wager is of the first wager amount using the processor;

after determining that the third wager is of the first wager amount, the gaming machine at least:

putting the gaming machine into the hot mode state; and carrying out the second hot mode spin using the third wager.

13. The method of claim 1, wherein the gaming machine is configured to be a standalone gaming machine.

14. The method of claim 1, wherein determining the outcome of the first random event comprises:

randomly determining one or more first symbols corresponding to a payline and one or more first reels; and determining a second symbol that corresponds to the payline and a second reel, wherein the second symbol causes the first payout to be greater than the first wager regardless of the one or more first symbols.

15. The method of claim 1, wherein determining the outcome of the first random event comprises:

randomly determining one or more first symbols corresponding to a payline and one or more first reels; and determining a second symbol that corresponds to the payline and a second reel, wherein the second symbol is a wild symbol.

16. The method of claim 1, wherein determining the outcome of the first random event comprises:

randomly determining one or more first symbols corresponding to a payline and one or more first reels; and determining a second symbol that corresponds to the payline and a second reel, wherein the second symbol causes the first payout to be a multiple of a payout that corresponds to the one or more first symbols.

17. An article of manufacture including a non-transitory computer-readable medium, having stored thereon instructions that, upon execution by a processor of a gaming machine, cause the gaming machine to perform operations, the operations including:

determining that the gaming machine is in a hot mode state;

in response to determining that the gaming machine is in the hot mode state:

determining a number of hot mode spins;

performing each hot mode spin of the number of hot mode spins by:

receiving a first wager, determining an outcome of a first random event using the processor, generating a first display related to the outcome of the first random event, determining a first payout for the first wager based on the outcome of the first random event and a hot-mode return rate, wherein the hot-mode return rate is selected so that a first sum of payouts determined during the number of hot mode spins is expected to exceed a first sum of wagers made during the number of hot mode spins, and providing, by a payment interface coupled to the processor, a second payout based on the first payout if the outcome of the first random event is a win, determining that the gaming machine is in a normal mode state; and in response to determining that the gaming machine is in the normal mode state, for each of one or more normal mode spins:

receiving a second wager, determining a second outcome of a second random event, generating a second display related to the second outcome, determining a third payout for the second wager based on the outcome of the second random event and a normal mode return rate, wherein the normal mode return rate is selected so that a second sum of payouts determined during the one or more normal mode spins is expected to be less than a second sum of wagers made during the one or more normal mode spins, and providing, by the payment interface coupled to the processor, a fourth payout based on the third payout if the outcome of the second random event is a win.

18. The article of manufacture of claim 17, wherein the hot-mode return rate is selected so that the first sum of payouts determined during the number of hot mode spins does exceed the first sum of wagers made during the number of hot mode spins.

19. A gaming machine, comprising:

a processor;

a memory; and program instructions, stored in the memory, that upon execution by the processor cause the gaming machine to perform operations comprising:

determining that the gaming machine is in a hot mode state;

in response to determining that the gaming machine is in the hot mode state:

determining a number of hot mode spins;

performing each hot mode spin of the number of hot mode spins by:

receiving a first wager, determining an outcome of a first random event using the processor, generating a first display related to the outcome of the first random event, determining a first payout for the first wager based on the outcome of the first random event and a hot-mode return rate, wherein the hot-mode return rate is selected so that a first sum of payouts determined during the number of hot mode spins is expected to exceed a first sum of wagers made during the number of hot mode spins, and providing, by a payment interface coupled to the processor, a second payout based on the first payout if the outcome of the first random event is a win, determining that the gaming machine is in a normal mode state; and in response to determining that the gaming machine is in the normal mode state, for each of one or more normal mode spins:

receiving a second wager, determining a second outcome of a second random event, generating a second display related to the second outcome, determining a third payout for the second wager based on the outcome of the second random event and a normal mode return rate, wherein the normal mode return rate is selected so that a second sum of payouts determined during the one or more normal mode spins is expected to be less than a second sum of wagers made during the one or more normal mode spins, and providing, by the payment interface coupled to the processor, a fourth payout based on the third payout if the outcome of the second random event is a win.

20. The gaming machine of claim 19, wherein the hot-mode return rate is selected so that the first sum of payouts determined during the number of hot mode spins does exceed the first sum of wagers made during the number of hot mode spins.

* * * * *